US009328944B2

(12) United States Patent
Kinoshita

(10) Patent No.: US 9,328,944 B2
(45) Date of Patent: May 3, 2016

(54) AIR CONDITIONING APPARATUS

(75) Inventor: Hidehiko Kinoshita, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1120 days.

(21) Appl. No.: 13/256,389

(22) PCT Filed: Mar. 19, 2010

(86) PCT No.: PCT/JP2010/001985

§ 371 (c)(1),
(2), (4) Date: Sep. 13, 2011

(87) PCT Pub. No.: WO2010/106815

PCT Pub. Date: Sep. 23, 2010

(65) Prior Publication Data

US 2012/0000223 A1 Jan. 5, 2012

(30) Foreign Application Priority Data

Mar. 19, 2009 (JP) ..... 2009-069121

(51) Int. Cl.
*F25B 25/00* (2006.01)
*F25B 13/00* (2006.01)
*F25B 47/02* (2006.01)

(52) U.S. Cl.
CPC ..... *F25B 13/00* (2013.01); *F25B 47/02* (2013.01); *F25B 2313/005* (2013.01);
(Continued)

(58) Field of Classification Search
CPC ..... F25B 2313/0293; F25B 2313/0313; F25B 2313/0312; F24F 11/0001; F24F 11/0079; F24F 11/0012
USPC ..... 62/178, 186
See application file for complete search history.

(56) References Cited

U.S. PATENT DOCUMENTS 2,986,015 A * 5/1961 Mitchell ..... 62/115
3,405,535 A * 10/1968 Matthies ..... 62/202
(Continued)

FOREIGN PATENT DOCUMENTS

JP 52-150056 U 11/1977
JP 56-148576 U 11/1981
(Continued)

OTHER PUBLICATIONS

International Preliminary Report of corresponding PCT Application No. PCT/JP2010/001985.
(Continued)

*Primary Examiner* — Ljiljana Ciric
*Assistant Examiner* — Alex Cox
(74) *Attorney, Agent, or Firm* — Global IP Counselors

(57) ABSTRACT

An air conditioning apparatus includes a refrigeration circuit, a magnetic material member, a magnetic field generator, a detector and a controller. The refrigeration cycle has a compressor, an intake-side heat exchanger, a discharge-side heat exchanger, an expansion valve, and a refrigerant tube connected in series by first, second, third and fourth tube parts of the refrigerant tube to form a closed loop. The magnetic field generator generates a magnetic field in order to inductively heat the magnetic material member. The detector detects temperature or pressure in refrigerant flowing through a predetermined portion of the refrigerant circuit. The controller confirms satisfaction of a magnetic-field-generating-permission condition before initiating the magnetic field generator to generate the magnetic field after a startup of the compressor. The magnetic-field-generating-permission condition is that a value detected by the detector changes when the compressor executes two different compression states of different compressor outputs having different frequencies.

16 Claims, 27 Drawing Sheets

(52) U.S. Cl.
CPC .... *F25B 2313/006* (2013.01); *F25B 2313/008* (2013.01); *F25B 2313/02741* (2013.01); *F25B 2313/0312* (2013.01); *F25B 2313/0314* (2013.01); *F25B 2313/0315* (2013.01); *F25B 2500/02* (2013.01); *F25B 2700/2104* (2013.01)

(56) References Cited

U.S. PATENT DOCUMENTS

| | | | | |
|---|---|---|---|---|
| 3,817,053 | A * | 6/1974 | Orth | 62/210 |
| 5,715,693 | A * | 2/1998 | van der Walt et al. | 62/198 |
| 8,033,718 | B2 * | 10/2011 | Nishiyashiki | 374/141 |
| 8,413,455 | B2 * | 4/2013 | Sim et al. | 62/196.1 |
| 2002/0056280 | A1 | 5/2002 | Kim | |
| 2003/0172667 | A1 | 9/2003 | Takano et al. | |
| 2003/0213256 | A1 | 11/2003 | Ueda et al. | |
| 2004/0134225 | A1 * | 7/2004 | Sakamoto et al. | 62/498 |
| 2007/0062207 | A1 * | 3/2007 | Aiyama et al. | 62/222 |
| 2007/0163297 | A1 * | 7/2007 | Zhang et al. | 62/527 |
| 2009/0025406 | A1 * | 1/2009 | Yoshimi et al. | 62/127 |
| 2009/0044550 | A1 * | 2/2009 | Nishimura et al. | 62/149 |
| 2010/0324742 | A1 * | 12/2010 | Huerta-Ochoa | 700/282 |
| 2012/0096882 | A1 * | 4/2012 | Yang | 62/180 |
| 2014/0374062 | A1 * | 12/2014 | Ono et al. | 165/71 |
| 2014/0374078 | A1 * | 12/2014 | Ono et al. | 165/173 |

FOREIGN PATENT DOCUMENTS

| | | | |
|---|---|---|---|
| JP | 61-140738 | A | 6/1986 |
| JP | 61-246537 | A | 11/1986 |
| JP | 62-77574 | A | 4/1987 |
| JP | 1-111153-A11 | | 4/1989 |
| JP | 3-59358 | A | 3/1991 |
| JP | 4-15446 | A | 1/1992 |
| JP | 4-80562 | A | 3/1992 |
| JP | 7-301459 | A | 11/1995 |
| JP | 11-248265 | A | 9/1999 |
| JP | 2000-28180 | A | 1/2000 |
| JP | 2000-97510 | A | 4/2000 |
| JP | 2000-220912 | A | 8/2000 |
| JP | 2001-174055 | A | 6/2001 |
| JP | 2001-255025 | A | 9/2001 |
| JP | 2002-5537 | A | 1/2002 |
| JP | 2002-106980 | A | 4/2002 |
| JP | 2002-195669 | A | 7/2002 |
| JP | 2003-42574 | A | 2/2003 |
| JP | 2003-269810 | A | 9/2003 |
| JP | 2004-3804 | A | 1/2004 |
| JP | 2004-3827 | A | 1/2004 |
| JP | 2007-127381 | A | 5/2007 |
| JP | 2007-178114 | A | 7/2007 |
| JP | 2007-212035 | A | 8/2007 |
| JP | 2007-212036 | A | 8/2007 |
| JP | 2007-255736 | A | 10/2007 |
| JP | 2008-2790 | A | 1/2008 |
| JP | 2008-164226 | A | 7/2008 |
| WO | WO 2007/119414 | A1 | 10/2007 |

OTHER PUBLICATIONS

International Preliminary Report of related PCT Application No. PCT/JP2010/001965.
International Preliminary Report of related PCT Application No. PCT/JP2010/002005.
International Preliminary Report of related PCT Application No. PCT/JP2010/001937.
International Preliminary Report of related PCT Application No. PCT/JP2010/001941.
International Preliminary Report of related PCT Application No. PCT/JP2010/001983.
International Preliminary Report of related PCT Application No. PCT/JP2010/001815.
International Preliminary Report of related PCT Application No. PCT/JP2010/001942.
International Preliminary Report of related PCT Application No. PCT/JP2010/001994.
Corrected Version of international Preliminary Report of related PCT Application No. PCT/JP2010/001941.
International Search Report of corresponding PCT Application No. PCT/JP2010/001985.
International Search Report of corresponding PCT Application No. PCT/JP2010/001965.
International Search Report of corresponding PCT Application No. PCT/JP2010/001815.
International Search Report of corresponding PCT Application No. PCT/JP2010/001942.
International Search Report of corresponding PCT Application No. PCT/JP2010/001941.
International Search Report of corresponding PCT Application No. PCT/JP2010/001994.
International Search Report of corresponding PCT Application No. PCT/JP2010/002005.
International Search Report of corresponding PCT Application No. PCT/JP2010/001937.
International Search Report of corresponding PCT Application No. PCT/JP2010/001983.

* cited by examiner

AIR CONDITIONING APPARATUS

CROSS-REFERENCE TO RELATED APPLICATIONS

This U.S. National stage application claims priority under 35 U.S.C. §119(a) to Japanese Patent Application No. 2009-069121, filed in Japan on Mar. 19, 2009, the entire contents of which are hereby incorporated herein by reference.

TECHNICAL FIELD

The present invention relates to an air conditioning apparatus.

BACKGROUND ART

Among air conditioning apparatuses capable of an air-warming operation, there have been those proposed which include a refrigerant heating function intended to increase air-warming capability.

For example, in the air conditioning apparatus disclosed in Japanese Laid-open Patent Application Publication No. 2000-97510, the air-warming capability is increased due to the refrigerant flowing into a refrigerant heating device and being heated by a gas burner.

In the air conditioning apparatus disclosed in Japanese Laid-open Patent Application Publication No. 2000-97510, a technique is proposed in which the combustion rate of the gas burner is adjusted based on the detection value of a thermistor, in order to prevent the refrigerant temperature from rising too high and protective action from being taken too frequently during the air-warming operation.

SUMMARY

Technical Problem

In the technique disclosed in Japanese Laid-open Patent Application Publication No. 2000-97510, since the detection value of the thermistor is used as a determination reference, when the refrigerant temperature rises abnormally regardless of the detection value of the thermistor being within the proper range, such an abnormal temperature increase cannot be suppressed.

Since the heating rate is high when the refrigerant heating system is an electromagnetic induction heating system, preventing abnormal rises in refrigerant temperature is particularly in demand.

The present invention was devised in view of the circumstances described above, and an object thereof is to provide an air conditioning apparatus capable of preventing the refrigerant temperature from rising too high even when the refrigerant is heated by an electromagnetic induction heating system.

Solution to Problem

An air conditioning apparatus according to a first aspect is an air conditioning apparatus which uses a refrigeration cycle having a compression mechanism for circulating refrigerant, a refrigerant tube that makes thermal contact with the refrigerant flowing through the refrigerant tube and/or a heat-generating member that makes thermal contact with the refrigerant flowing through the refrigerant tube; the air conditioning apparatus comprising a magnetic field generator, a detector, and a control part. The heat-generating member may make thermal contact with the refrigerant flowing through the refrigerant tube while also making thermal contact with the refrigerant tube, the heat-generating member need not be in direct contact with the refrigerant flowing through the refrigerant tube while in thermal contact with the refrigerant tube, or the heat-generating member may make thermal contact with the refrigerant flowing through the refrigerant tube despite not making thermal contact with the refrigerant tube. The magnetic field generator generates a magnetic field for induction-heating the heat-generating member. The detector either detect temperature or temperature change or detect pressure or pressure change in refrigerant flowing through predetermined portion that is at least one part of the refrigeration cycle. The control part permits the magnetic field generator to generate the magnetic field when a magnetic-field-generating-permission condition is satisfied. The magnetic-field-generating-permission condition is that either the values detected by the detector change in the first compression mechanism state and second compression mechanism state or that a change be detected between the detection value of the detector in the first compression mechanism state and the detection value of the detector in the second compression mechanism state, when the compression mechanism executes two compression mechanism states of different compression mechanism outputs, one being the first compression mechanism state and the other being the higher second compression mechanism state. The second compression mechanism state is a state of a higher output level than the first compression mechanism state. The first compression mechanism state also includes stopping of the compression mechanism.

In this air conditioning apparatus, when the magnetic-field-generating-permission condition is not satisfied, it can be perceived that a quantity of refrigerant flowing through the predetermined portions is not sufficiently ensured, and the control part does not permit the magnetic field generator to operate. Therefore, electromagnetic induction heating can be inhibited in a state resembling heating an empty container, and abnormal refrigerant temperature increases can be prevented. On the other hand, the magnetic field generator is permitted to generate the magnetic field when the magnetic-field-generating-permission condition is satisfied. It is thereby possible to quickly heat the refrigerant while preventing abnormal refrigerant temperature increases.

An air conditioning apparatus according to a second aspect is the air conditioning apparatus of the first aspect, wherein the detector is temperature detector for detecting temperature or temperature change.

In this air conditioning apparatus, since the temperature detector detects temperature or temperature change, the refrigerant can be quickly heated while preventing abnormal refrigerant temperature increases, by directly perceiving the temperature or temperature changes.

An air conditioning apparatus according to the third aspect is the air conditioning apparatus of the first or second aspect, wherein the heat-generating member contains a magnetic material.

In this air conditioning apparatus, since the magnetic field generator generates a magnetic field using the portion containing the magnetic material as a target, heat generation by electromagnetic induction can be performed efficiently.

An air conditioning apparatus according to a fourth aspect is the air conditioning apparatus according to any of the first through third aspects, wherein the refrigeration cycle further has an intake-side heat exchanger capable of connecting to an intake side of the compression mechanism, a discharge-side heat exchanger capable of connecting to a discharge side of the compression mechanism, and an expansion mechanism capable of lowering the pressure of refrigerant flowing from the discharge-side heat exchanger to the intake-side heat exchanger. When the compression mechanism is in the second compression mechanism state, the control part performs startup degree of opening control. In this startup degree of opening control, the degree of opening of the expansion mechanism is narrowed so that the degree of opening will be narrower than the degree of opening of the expansion mechanism under the same conditions as subcooling degree constant control. In this subcooling degree constant control, the subcooling degree is made constant in refrigerant flowing to the expansion mechanism side of the discharge-side heat exchanger. Possible examples that could be these same conditions include the compression mechanism frequency, the outside air temperature, heat load, and other factors.

In this air conditioning apparatus, when the control part puts the compression mechanism into the second compression mechanism state, since the degree of opening of the expansion mechanism is controlled to be narrower, the refrigerant pressure in the intake side decreases readily. The detector can thereby confirm that refrigerant is flowing by detecting the decrease in the refrigerant temperature in the intake side, when detecting temperature, for example. The detector can also confirm that refrigerant is flowing by detecting decrease in the intake-side refrigerant temperature as temperature changes, when detecting temperature changes, for example. The detector can also confirm that refrigerant is flowing by detecting increase in the discharge pressure of refrigerant discharged from the compression mechanism, when detecting pressure, for example. The detector can also confirm that refrigerant is flowing by detecting the change when the discharge pressure of refrigerant discharged from the compression mechanism increases, when detecting pressure changes, for example.

Since a state of refrigerant flow is ensured inside the predetermined portions even when electromagnetic induction heating is performed, the heat produced by induction heating is thereby impeded from accumulating, and it is possible to prevent abnormal increases in the refrigerant temperature when electromagnetic induction heating is performed.

An air conditioning apparatus according to a fifth aspect is the air conditioning apparatus according to any of the first through fourth aspects, wherein the control part permits the magnetic field generator to generate the magnetic field upon satisfaction of both the magnetic-field-generating-permission condition and a flow ensuring condition. The flow ensuring condition is an operating condition in which at least the output level of the compression mechanism is maintained either at a higher output level than the second compression mechanism state or maintained at the second compression mechanism state.

In this air conditioning apparatus, when it is successfully confirmed that refrigerant is flowing due to the magnetic-field-generating-permission condition being satisfied, it is possible to more reliably confirm that a flow is ensured than when the magnetic-field-generating-permission condition is satisfied by further determining that the flow ensuring condition is satisfied. Therefore, abnormal increases in the refrigerant temperature can be more reliably prevented.

An air conditioning apparatus according to a sixth aspect is the air conditioning apparatus according to any of the first through fifth aspects, wherein the first compression mechanism state is a state in which a determining minimum flow quantity of the refrigerant is ensured. The second compression mechanism state is a state that continues after the first compression mechanism state, wherein a refrigerant flow quantity is ensured that exceeds the determining minimum flow quantity.

In this air conditioning apparatus, when the magnetic-field-generating-permission condition is satisfied, it is successfully confirmed that a change in refrigerant temperature or a change in refrigerant pressure has been detected in a state in which the refrigerant flow quantity has been further increased from a state ensuring the determining minimum flow quantity. Thus, by increasing the refrigerant flow quantity in this manner, not only is it possible to simply perceive that refrigerant is flowing, but it is also possible to confirm that a state is in effect that impedes abnormal increases in refrigerant temperature even through the refrigerant flow quantity has been further increased.

An air conditioning apparatus according to a seventh aspect is the air conditioning apparatus of the second aspect, wherein the refrigeration cycle further has an intake-side heat exchanger capable of connecting to an intake side of the compression mechanism, a discharge-side heat exchanger capable of connecting to a discharge side of the compression mechanism, and an expansion mechanism capable of lowering the pressure of refrigerant flowing from the discharge-side heat exchanger to the intake-side heat exchanger. The predetermined portion is at least one of the following: the intake-side heat exchanger, the upstream vicinity of the intake-side heat exchanger, and the downstream vicinity of the intake-side heat exchanger.

In this air conditioning apparatus, the temperature detector can precisely detect the temperature or decrease in the temperature of the refrigerant passing through at least any one of the portions including the intake-side heat exchanger, the upstream vicinity of the intake-side heat exchanger, and the downstream vicinity of the intake-side heat exchanger.

An air conditioning apparatus according to an eighth aspect is the air conditioning apparatus according to any of the first through seventh aspects, wherein after the output level of the compression mechanism has fallen to or below the first compression mechanism state, the control part permits the magnetic field generator to generate the magnetic field on the condition that the magnetic-field-generating-permission condition be again satisfied.

In this air conditioning apparatus, it is possible to maintain the reliability of the devices by again determining magnetic-field-generating-permission condition, even when there is a risk of a change in the refrigerant circulating condition due to a change in the refrigeration cycle condition.

An air conditioning apparatus according to a ninth aspect is the air conditioning apparatus according to any of the first through eighth aspects, further comprising a communication part for communicating that the refrigerant is not being appropriately supplied. The control part causes the communication part to communicate when the magnetic-field-generating-permission condition is not satisfied.

In this air conditioning apparatus, it is possible for nearby users to be notified that there is no assurance of a refrigerant circulation amount sufficient to suppress the rate of refrigerant temperature increase caused by electromagnetic induction heating, due to the magnetic-field-generating-permission condition not being satisfied.

An air conditioning apparatus according to a tenth aspect is the air conditioning apparatus of the first or second aspect, wherein the control part is capable of adjusting the magnitude of the magnetic field of the magnetic field generator. The control part permits the magnetic field generator to generate the magnetic field at maximum output only when all of the following are satisfied: the magnetic-field-generating-permission condition, a flow ensuring condition, and a magnetic-field-maximum-output-permission condition. The flow ensuring condition is a condition in which the output level of the compression mechanism is maintained either at a higher output level than the second compression mechanism state or at the second compression mechanism state. The magnetic-field-maximum-output-permission condition is a condition in which the difference in the detection result of the detector before and after the magnetic field is generated by the magnetic field generator is less than a predetermined determining difference while the output level of the compression mechanism is maintained at either a constant level or a constant range level.

In this air conditioning apparatus, it is possible to confirm that the detecting state of the detector and the refrigerant flow quantity in the predetermined portion are sufficiently ensured, before the output of the magnetic field generator reaches a maximum. The reliability of the device can thereby be improved, even in cases in which the output of the magnetic field generator reaches a maximum.

An air conditioning apparatus according to an eleventh aspect is the air conditioning apparatus of the second aspect, further comprising an elastic member for applying elastic force to the temperature detector. The temperature detector is pressed against the predetermined portion by the elastic force of the elastic members.

When electromagnetic induction heating is performed, it is common for sudden temperature increases in the predetermined portion to occur more readily than temperature increases caused by changes in the refrigerant circulating condition in the refrigeration cycle.

In this air conditioning apparatus, since the temperature detector is kept pressed against the predetermined portion by the elastic member, the responsiveness of the temperature detector can be improved. Thereby, control with improved responsiveness can be performed.

Advantageous Effects of Invention

In the air conditioning apparatus according to the first aspect, it is possible to quickly heat the refrigerant while preventing abnormal refrigerant temperature increases.

In the air conditioning apparatus according to the second aspect, the refrigerant can be quickly heated while preventing abnormal refrigerant temperature increases, by directly perceiving the temperature or temperature changes.

In the air conditioning apparatus according to the third aspect, heat generation by electromagnetic induction can be performed efficiently.

In the air conditioning apparatus according to the fourth aspect, it is possible to prevent abnormal increases in the refrigerant temperature when electromagnetic induction heating is performed.

In the air conditioning apparatus according to the fifth aspect, abnormal increases in the refrigerant temperature can be more reliably prevented.

In the air conditioning apparatus according to the sixth aspect, not only is it possible to simply perceive that refrigerant is flowing, but it is also possible to confirm that a state is in effect that impedes abnormal increases in refrigerant temperature even through the refrigerant flow quantity has been further increased.

In the air conditioning apparatus according to the seventh aspect, the temperature detector can precisely detect the temperature or decrease in the temperature of the refrigerant passing through at least any one of the portions including the intake-side heat exchanger, the upstream vicinity of the intake-side heat exchanger, and the downstream vicinity of the intake-side heat exchanger.

In the air conditioning apparatus according to the eighth aspect, the reliability of the devices can be maintained.

In the air conditioning apparatus according to the ninth aspect, it is possible for nearby users to be notified that there is no assurance of a refrigerant circulation amount sufficient to suppress the rate of refrigerant temperature increase caused by electromagnetic induction heating.

In the air conditioning apparatus according to the tenth aspect, the reliability of the devices can be improved, even in cases in which the output of the magnetic field generator reaches a maximum.

In the air conditioning apparatus according to the eleventh aspect, control with improved responsiveness can be performed.

DESCRIPTION OF EMBODIMENTS

An air conditioning apparatus 1 comprising an electromagnetic induction heating unit 6 in one embodiment of the present invention is described in an example hereinbelow with reference to the drawings.

<1-1> Air Conditioning Apparatus 1

Figure 1:
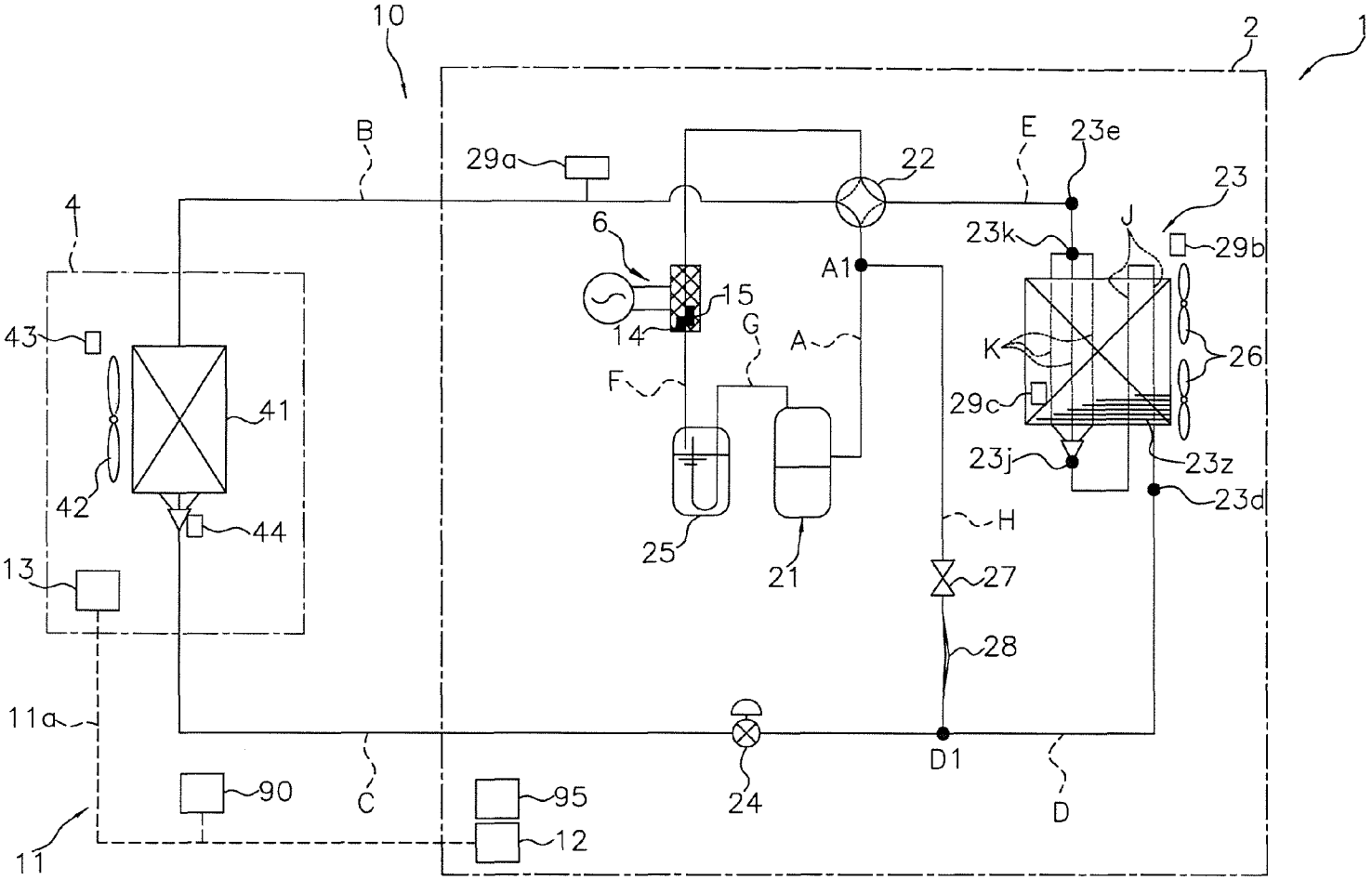
FIG. 1 is a refrigerant circuit diagram of an air conditioning apparatus according to an embodiment of the present invention.

FIG. 1 shows a refrigerant circuit diagram showing a refrigerant circuit 10 of the air conditioning apparatus 1.

In the air conditioning apparatus 1, an outdoor unit 2 as a heat source-side apparatus and an indoor unit 4 as a usage-side apparatus are connected by refrigerant tubes, and air conditioning is performed in the space where the usage-side apparatus is located; the air conditioning apparatus 1 comprising a compressor 21, a four-way switching valve 22, an outdoor heat exchanger 23, an outdoor electric expansion valve 24, an accumulator 25, outdoor fans 26, an indoor heat exchanger 41, an indoor fan 42, a hot gas bypass valve 27, a capillary tube 28, an electromagnetic induction heating unit 6, and other components.

The compressor 21, the four-way switching valve 22, the outdoor heat exchanger 23, the outdoor electric expansion valve 24, the accumulator 25, the outdoor fans 26, the hot gas bypass valve 27, the capillary tube 28, and the electromagnetic induction heating unit 6 are housed within the outdoor unit 2. The indoor heat exchanger 41 and the indoor fan 42 are housed within the indoor unit 4.

The refrigerant circuit 10 has a discharge tube A, an indoor-side gas tube B, an indoor-side liquid tube C, an outdoor-side liquid tube D, an outdoor-side gas tube E, an accumulation tube F, an intake tube G, a hot gas bypass circuit H, a branched tube K, and a converging tube J. Large quantities of gas-state refrigerant pass through the indoor-side gas tube B and the outdoor-side gas tube E, but the refrigerant passing through is not limited to a gas refrigerant. Large quantities of liquid-state refrigerant pass through the indoor-side liquid tube C and the outdoor-side liquid tube D, but the refrigerant passing through is not limited to a liquid refrigerant.

The discharge tube A is connected with the compressor 21 and the four-way switching valve 22.

The indoor-side gas tube B connects the four-way switching valve 22 and the indoor heat exchanger 41. A pressure sensor 29*a* for sensing the pressure of the refrigerant passing through is provided at some point along the indoor-side gas tube B.

The indoor-side liquid tube C connects the indoor heat exchanger 41 and the outdoor electric expansion valve 24.

The outdoor-side liquid tube D connects the outdoor electric expansion valve 24 and the outdoor heat exchanger 23.

The outdoor-side gas tube E connects the outdoor heat exchanger 23 and the four-way switching valve 22.

Figure 15:
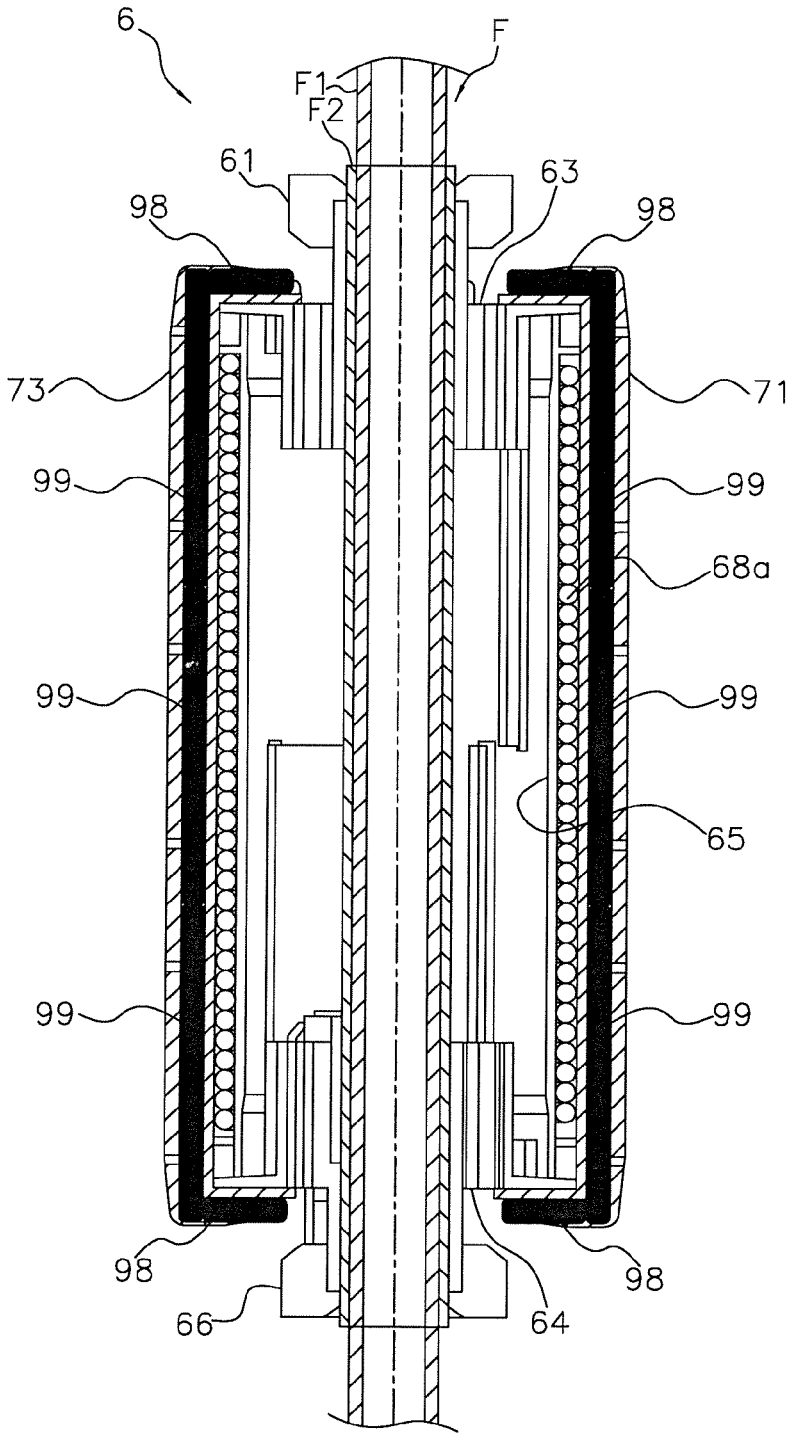
FIG. 15 is a cross-sectional structural view of the electromagnetic induction heating unit.

The accumulation tube F connects the four-way switching valve 22 and the accumulator 25, and extends in a vertical direction when the outdoor unit 2 has been installed. The electromagnetic induction heating unit 6 is attached to a part of the accumulation tube F. A heat-generating portion of the accumulation tube F, whose periphery is covered at least by a coil 68 described hereinafter, is composed of a copper tube F1 through which refrigerant flows and a magnetic tube F2 provided so as to cover the periphery of the copper tube F1 (see FIG. 15). This magnetic tube F2 is composed of SUS (stainless used steel) 430. This SUS 430 is a ferromagnetic material, which creates eddy currents when placed in a magnetic field and which generates heat by Joule heat created by its own electrical resistance. Aside from the magnetic tube F2, the tubes constituting the refrigerant circuit 10 are composed of copper tubes. The material of the tubes covering the peripheries of these copper tubes is not limited to SUS 430, and can be, for example, iron, copper, aluminum, chrome, nickel, other conductors, and alloys containing at least two or more metals selected from these listed. The example of the magnetic material given here contains ferrite, martensite, or a combination of the two, but it is preferable to use a ferromagnetic substance which has a comparatively high electrical resistance and which has a higher Curie temperature than its service temperature range. The accumulation tube F here requires more electricity, but may not comprise a magnetic substance and a material containing a magnetic substance, or may include a material that will be the target of induction heating. The magnetic material may constitute the entire accumulation tube F, or may be formed only in the inside surface of the accumulation tube F, or it may be present only due to being included in the material constituting the accumulation tube F, for example. By performing electromagnetic induction heating in this manner, the accumulation tube F can be heated by electromagnetic induction, and the refrigerant drawn into the compressor 21 via the accumulator 25 can be warmed. The warming capability of the air conditioning apparatus 1 can thereby be improved. Even in cases in which the compressor 21 is not sufficiently warmed at the start of the air-warming operation, for example, the lack of capability at startup can be compensated for by the quick heating by the electromagnetic induction heating unit 6. Furthermore, when the four-way switching valve 22 is switched to the air-cooling operation state and a defrosting operation is performed for removing frost deposited on the outdoor heat exchanger 23 or other components, the compressor 21 can quickly compress the warmed refrigerant due to the electromagnetic induction heating unit 6 quickly heating the accumulation tube F. Therefore, the temperature of the hot gas discharged from the compressor 21 can be quickly increased. The time required to thaw the frost through the defrosting operation can thereby be shortened. Thereby, even when the defrosting operation must be performed at the right time during the air-warming operation, a return to the air-warming operation can be made as quickly as possible, and user comfort can be improved.

The intake tube G connects the accumulator 25 and the intake side of the compressor 21.

The hot gas bypass circuit H connects a branching point A1 provided at some point along the discharge tube A and a branching point D1 provided at some point along the outdoor-side liquid tube D. Disposed at some point in the hot gas bypass circuit H is the hot gas bypass valve 27, which can switch between a state of permitting the passage of refrigerant and a state of not permitting the passage of refrigerant. Between the hot gas bypass valve 27 and the branching point D1, the hot gas bypass circuit H is provided with a capillary tube 28 for lowering the pressure of refrigerant passing through. This capillary tube 28 makes it possible to approach the pressure that follows the refrigerant pressure decrease by the outdoor electric expansion valve 24 during the air-warming operation, and therefore makes it possible to suppress the rise in refrigerant pressure in the outdoor-side liquid tube D caused by the supply of hot gas through the hot gas bypass circuit H to the outdoor-side liquid tube D.

The branched tube K, which constitutes part of the outdoor heat exchanger 23, consists of a refrigerant tube extending from a gas-side inlet/outlet 23*e* of the outdoor heat exchanger 23 and branching into a plurality of tubes at a branching/converging point 23*k* described hereinafter, in order to increase the effective surface area for heat exchange. The branched tube K has a first branched tube K1, a second branched tube K2, and a third branched tube K3 which extend independently from the branching/converging point 23*k* to a converging/branching point 23*j*, and these branching tubes K1, K2, K3 converge at the converging/branching point 23*j*. Seen from the side with the converging tube J, the branched tube K branches at and extends from the converging/branching point 23*j*.

The converging tube J, which constitutes a part of the outdoor heat exchanger 23, is a tube extending from the converging/branching point 23*j* to a liquid-side inlet/outlet 23*d* of the outdoor heat exchanger 23. The converging tube J is capable of equalizing the subcooling degree of the refrigerant flowing out from the outdoor heat exchanger 23 during the air-cooling operation, and is also capable of thawing ice deposited in the vicinity of the lower end of the outdoor heat exchanger 23 during the air-warming operation. The converging tube J has a cross-sectional area approximately three times each of those of the branching tubes K1, K2, K3, and the amount of refrigerant passing through is approximately three times greater than in each of the branching tubes K1, K2, K3.

The four-way switching valve 22 is capable of switching between an air-cooling operation cycle and an air-warming operation cycle. In FIG. 1, the connection state during the air-warming operation is shown by solid lines, and the connection state during the air-cooling operation is shown by dotted lines. During the air-warming operation, the indoor heat exchanger 41 functions as a cooler of refrigerant and the outdoor heat exchanger 23 functions as a heater of refrigerant. During the air-cooling operation, the outdoor heat exchanger 23 functions as a cooler of refrigerant and the indoor heat exchanger 41 functions as a heater of refrigerant.

The outdoor heat exchanger 23 has the gas-side inlet/outlet 23*e*, the liquid-side inlet/outlet 23*d*, the branching/converging point 23*k*, the converging/branching point 23*j*, the branched tube K, the converging tube J, and heat exchange fins 23*z*. The gas-side inlet/outlet 23*e* is positioned in the end of the outdoor heat exchanger 23 next to the outdoor-side gas tube E, and is connected to the outdoor-side gas tube E. The liquid-side inlet/outlet 23*d* is positioned in the end of the outdoor heat exchanger 23 next to the outdoor-side liquid tube D, and is connected to the outdoor-side liquid tube D. The branching/converging point 23*k* is where the tube extending from the gas-side inlet/outlet 23*e* branches, and the refrigerant can branch or converge depending on the direction in which the refrigerant is flowing. The branched tube K extends as a plurality of tubes from each of the branched portions in the branching/converging point 23*k*. The converging/branching point 23*j* is where the branched tube K converges, and the refrigerant can converge or branch depending on the direction in which the refrigerant is flowing. The converging tube J extends from the converging/branching point 23*j* to the liquid-side inlet/outlet 23*d*. The heat exchange fins 23*z* are composed of a plurality of plate-shaped aluminum fins aligned in their plate-thickness direction and arranged at predetermined intervals. The branched tube K and the converging tube J both pass through the heat exchange fins 23*z*. Specifically, the branched tube K and the converging tube J are arranged so as to penetrate in the plate-thickness direction through different parts of the same heat exchange fins 23*z*. Upwind side of the outdoor fans 26 in the direction of air flow, the outdoor heat exchanger 23 is provided with an outdoor air temperature sensor 29*b* for sensing the temperature of the outdoor air. The outdoor heat exchanger 23 is also provided with an outdoor heat exchange temperature sensor 29*c* for sensing the temperature of the refrigerant flowing through the branched tube air conditioning apparatus.

An indoor temperature sensor 43 for sensing the indoor temperature is provided inside the indoor unit 4. The indoor heat exchanger 41 is also provided with an indoor heat exchange temperature sensor 44 for sensing the refrigerant temperature of the side next to the indoor-side liquid tube C where the outdoor electric expansion valve 24 is connected.

An outdoor control part 12 for controlling the devices disposed in the outdoor unit 2 and an indoor control part 13 for controlling the devices disposed in the indoor unit 4 are connected by a communication line 11*a*, thereby constituting a control part 11. This control part 11 performs various controls on the air conditioning apparatus 1.

The outdoor control part 12 is also provided with a timer 95 for counting the elapsed time when the various controls are performed.

The control part 11 has a controller 90 for receiving setting input from the user.

<1-2> Outdoor Unit 2

Figure 2:
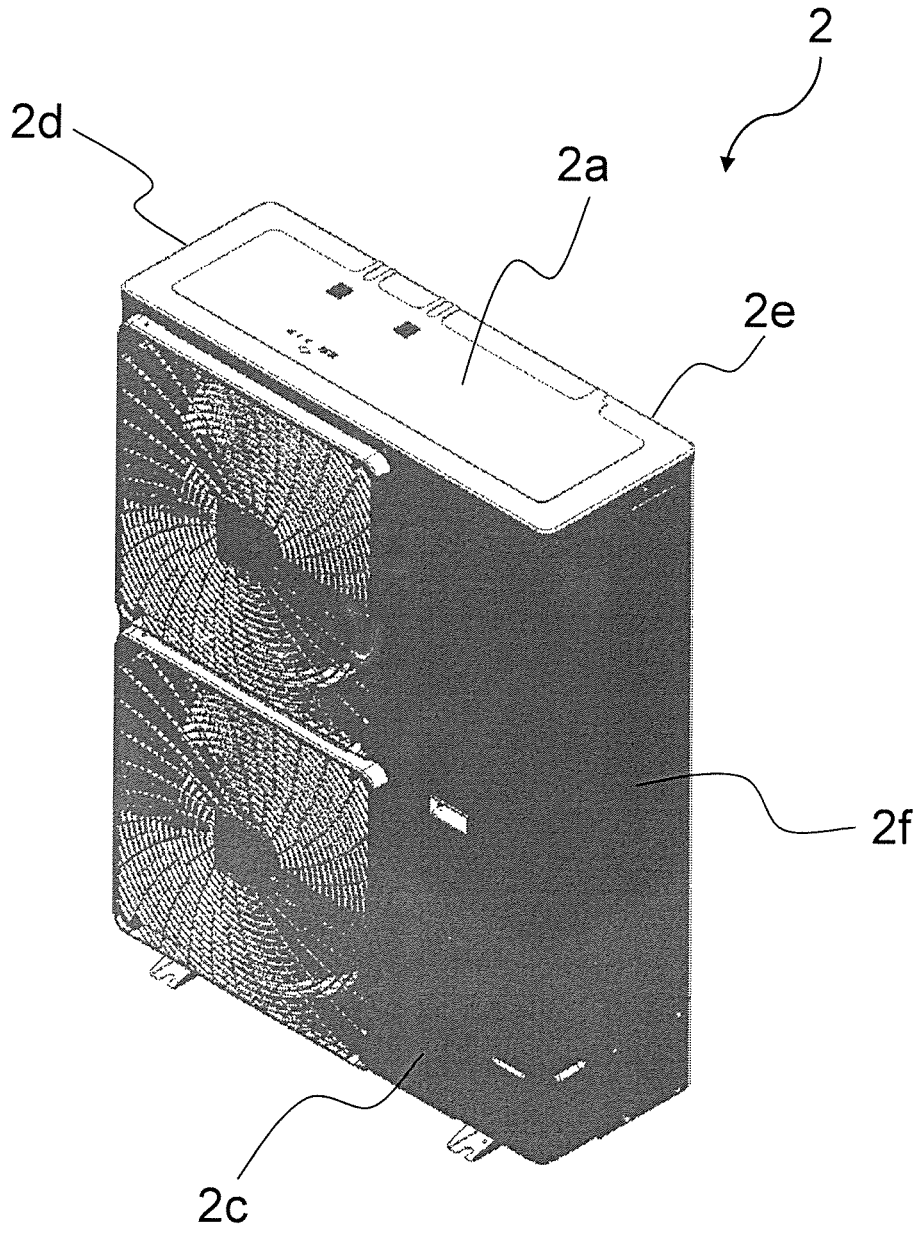
FIG. 2 is an external perspective view including the front side of an outdoor unit.
Figure 3:
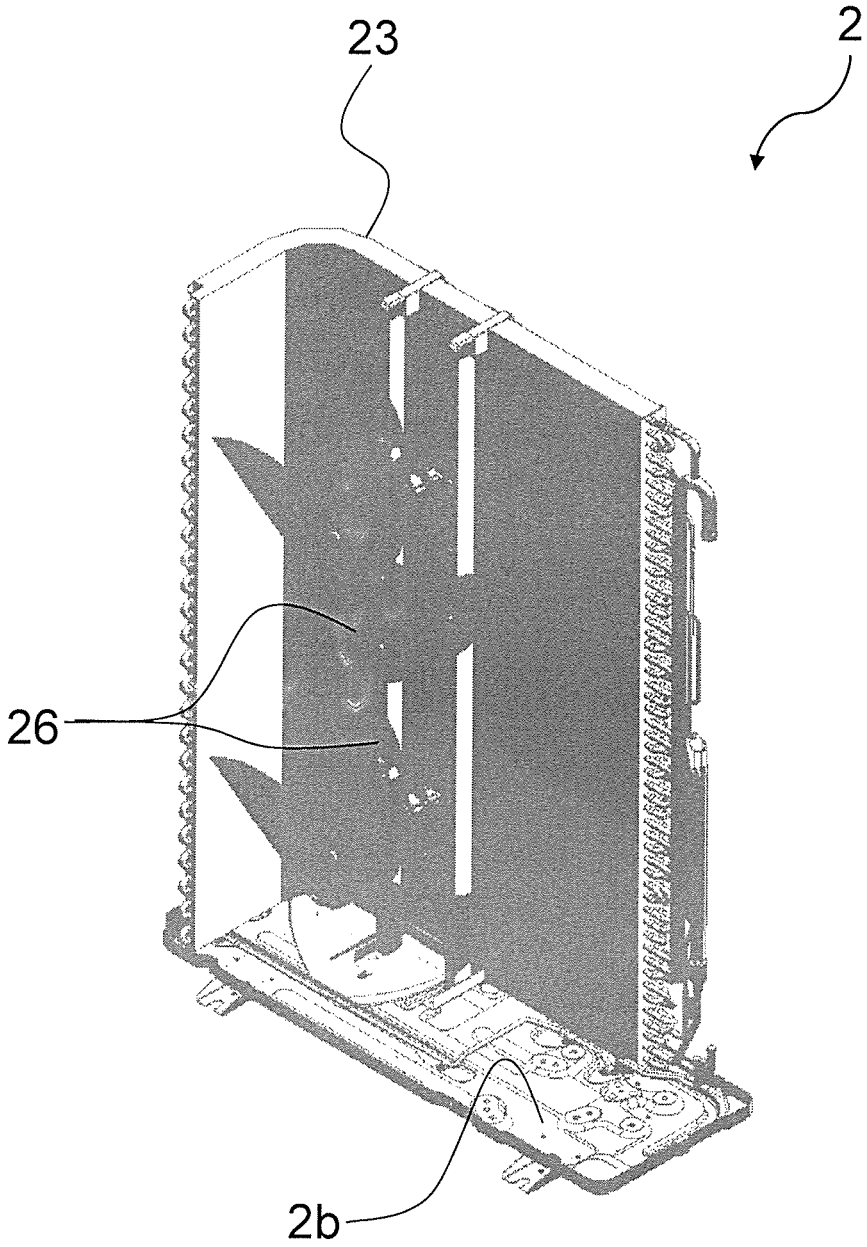
FIG. 3 is a perspective view of the internal arrangement and configuration of the outdoor unit.
Figure 4:
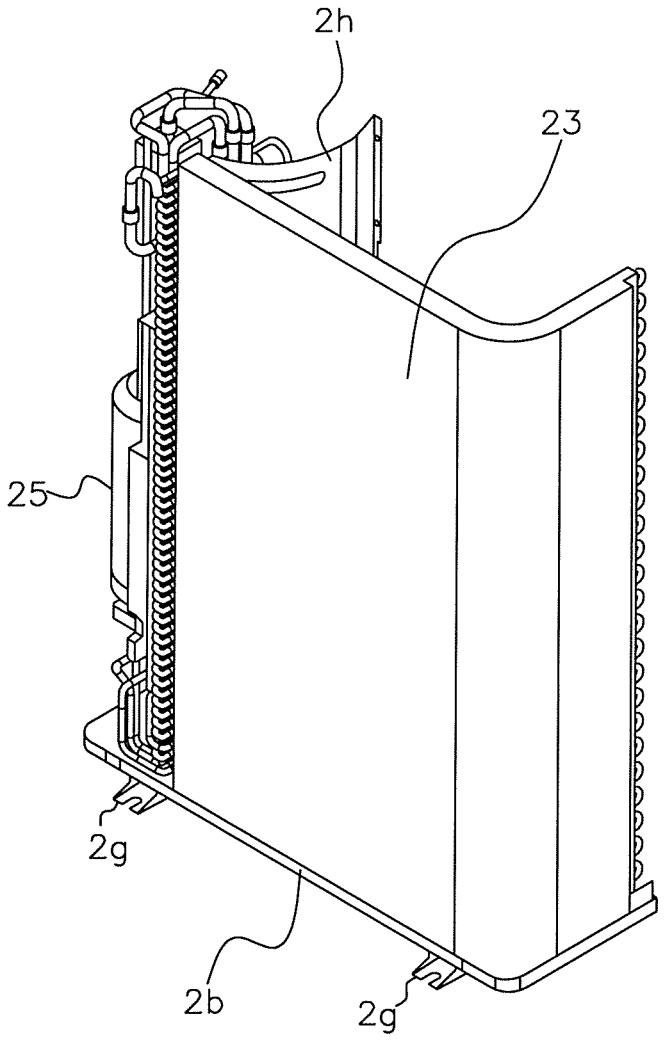
FIG. 4 is an external perspective view including the rear side of the internal arrangement and configuration of the outdoor unit.

FIG. 2 shows an external perspective view of the front side of the outdoor unit 2. FIG. 3 shows a perspective view depicting the positional relationship between the outdoor heat exchanger 23 and the outdoor fans 26. FIG. 4 shows a perspective view of the rear side of the outdoor heat exchanger 23.

The outside surfaces of the outdoor unit 2 are configured from a substantially rectangular parallelepiped outdoor unit casing, which is configured from a ceiling plate 2*a*, a bottom plate 2*b*, a front panel 2*c*, a left side panel 2*d*, a right side panel 2*f*, and a rear side panel 2*e*.

The outdoor unit 2 is sectioned via a partitioning plate 2H into an air-blower chamber next to the left side panel 2*d*, in which the outdoor heat exchanger 23, the outdoor fans 26, and other components are placed; and a machine chamber next to the right side panel 2*f*, where the compressor 21 and/or the electromagnetic induction heating unit 6 are placed. The outdoor unit 2 is fixed in place by being screwed onto the bottom plate 2*b*, and the outdoor unit 2 has an outdoor unit support stand 2G constituting the left and right sides of the lowest end of the outdoor unit 2. The electromagnetic induction heating unit 6 is disposed in the machine chamber, in an upper position in proximity to the right side panel 2*f* and the ceiling plate 2*a*. The heat exchange fins 23*z* of the outdoor heat exchanger 23 described above are arranged so as to be aligned in the plate-thickness direction while the plate-thickness direction runs generally horizontally. The converging tube J is placed in the lowest parts of the heat exchange fins 23*z* of the outdoor heat exchanger 23, by passing through the heat exchange fins 23*z* in the thickness direction. The hot gas bypass circuit H is disposed so as to extend below the outdoor fans 26 and the outdoor heat exchanger 23.

<1-3> Internal Configuration of Outdoor Unit 2

Figure 5:
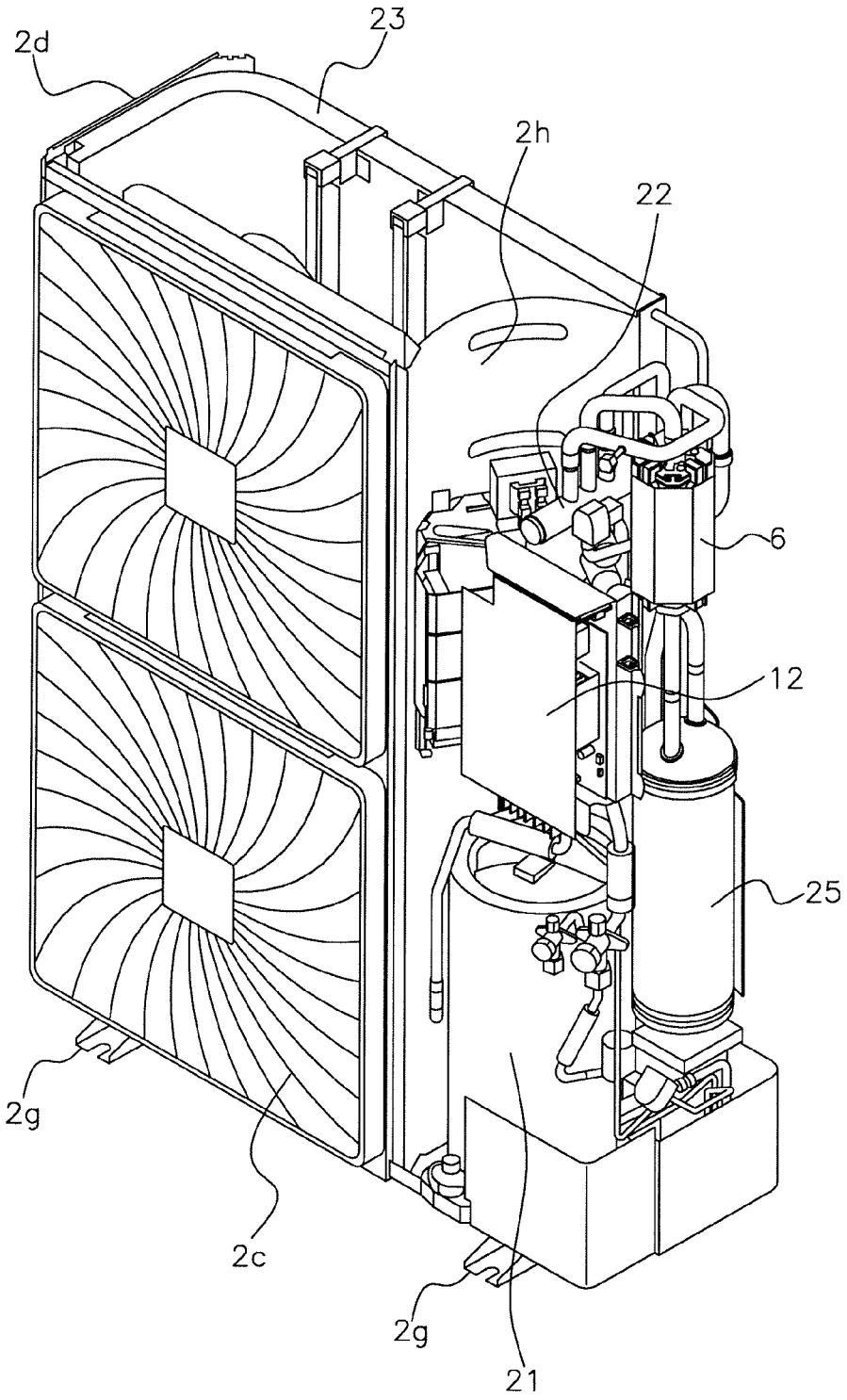
FIG. 5 is an overall front perspective view showing the internal structure of a machine chamber of the outdoor unit.
Figure 6:
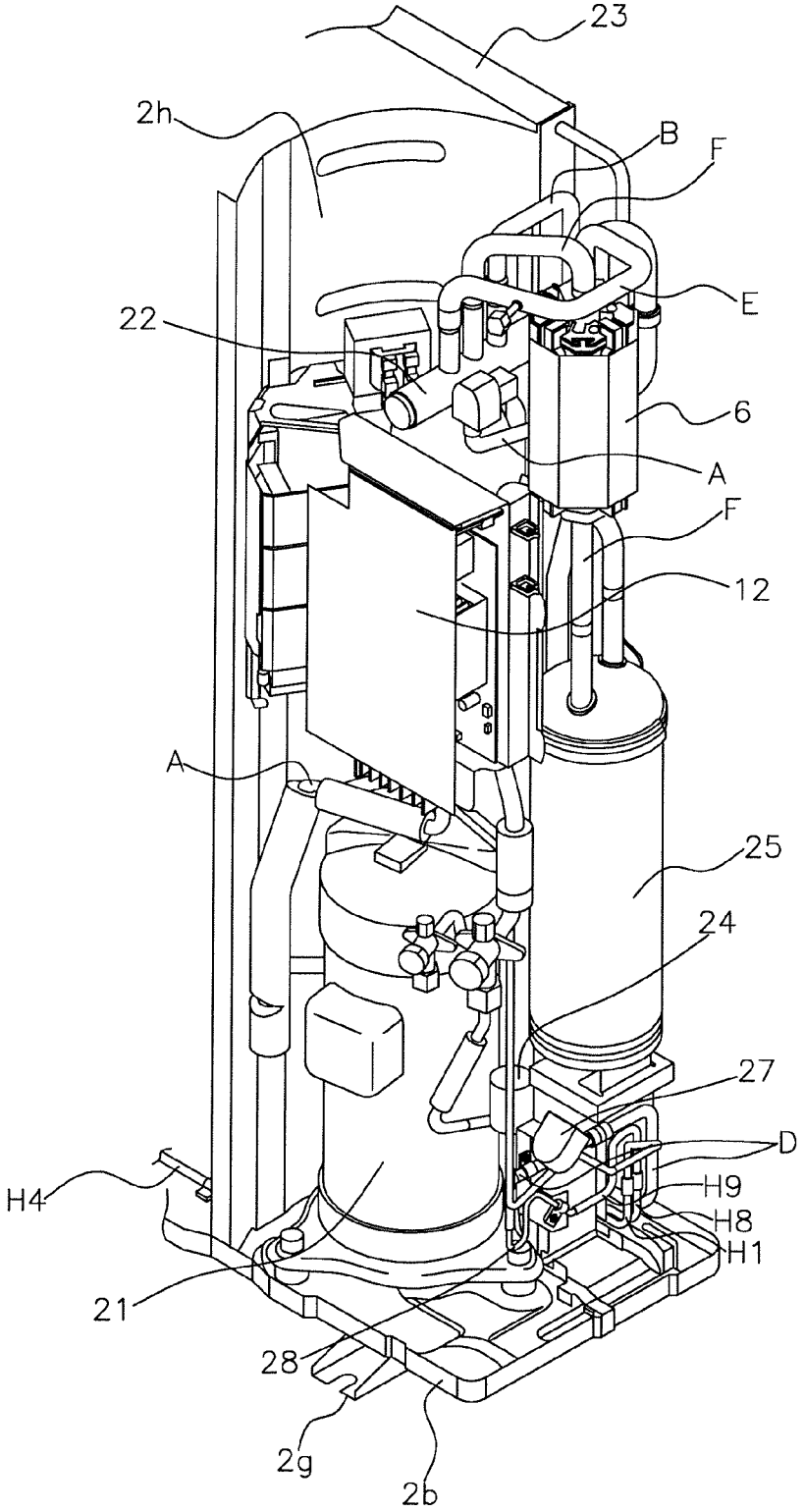
FIG. 6 is a perspective view showing the internal structure of the machine chamber of the outdoor unit.

FIG. 5 shows an overall front perspective view showing the internal structure of the machine chamber of the outdoor unit 2. FIG. 6 shows a perspective view showing the internal structure of the machine chamber of the outdoor unit 2. FIG.

7 shows a perspective view depicting the arrangement relationship between the outdoor heat exchanger 23 and the bottom plate 2*b*.

The partitioning plate 2H partitions the outdoor unit 2 frontward to rearward from the top end to the bottom end, so as to section the outdoor unit 2 into an air-blower chamber in which the outdoor heat exchanger 23, the outdoor fans 26, and other components are placed, and a machine chamber in which the electromagnetic induction heating unit 6, the compressor 21, the accumulator 25, and other components are placed. The compressor 21 and the accumulator 25 are placed in a space below the machine chamber of the outdoor unit 2. The electromagnetic induction heating unit 6, the four-way switching valve 22, and the outdoor control part 12 are placed in an upper space of the machine chamber of the outdoor unit 2, which is also a space at the top of the compressor 21, the accumulator 25, and other components. The functional elements constituting the outdoor unit 2 and placed in the machine chamber, which are the compressor 21, the four-way switching valve 22, the outdoor heat exchanger 23, the outdoor electric expansion valve 24, the accumulator 25, the hot gas bypass valve 27, the capillary tube 28, and the electromagnetic induction heating unit 6, are connected via the discharge tube A, the indoor-side gas tube B, the outdoor-side liquid tube D, the outdoor-side gas tube E, the accumulation tube F, the hot gas bypass circuit H, and other components so that the refrigeration cycle is performed by the refrigerant circuit 10 shown in FIG. 1. The hot gas bypass circuit H is configured from nine portions linked, which are a first bypass portion H1 through to a ninth bypass portion H9 as described hereinafter, and when refrigerant flows through the hot gas bypass circuit H, the refrigerant flows sequentially from the first bypass portion H1 to the ninth bypass portion H9.

<1-4> Converging Tube J and Branched Tube K

Figure 7:
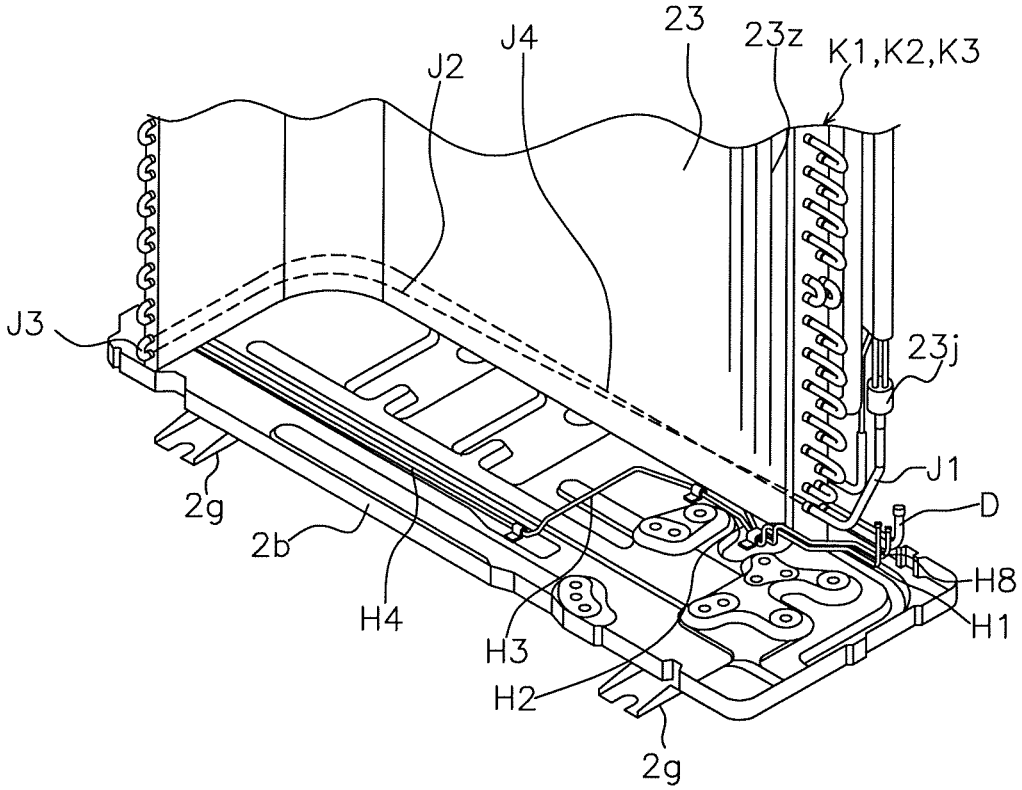
FIG. 7 is a perspective view of a bottom plate and an outdoor heat exchanger of the outdoor unit.

The converging tube J shown in FIG. 7 has a cross-sectional area equivalent to the cross-sectional areas of the first branched tube K1, the second branched tube K2, and the third branched tube K3 as described above, and within the outdoor heat exchanger 23, the portion containing the first branched tube K1, the second branched tube K2, and the third branched tube K3 can be increased in heat exchange effective surface area over that of the converging tube J. In the portion of the converging tube J, a large amount of refrigerant collects and flows intensively in comparison with the portion of the first branched tube K1, the second branched tube K2, and the third branched tube K3, and the formation of ice below the outdoor heat exchanger 23 can therefore be suppressed more effectively. The converging tube J herein is composed of a first converging tube portion J1, a second converging tube portion J2, a third converging tube portion J3, and a fourth converging tube portion J4 connected to each other, as shown in FIG. 7. Refrigerant that has flowed into the outdoor heat exchanger 23 through the branched tube K converges at the converging/branching point 23*j*, and the configuration permits the refrigerant in the refrigerant circuit 10 to make a pass through the lowest end of the outdoor heat exchanger 23 after having collected into one flow. The first converging tube portion J1 extends from the converging/branching point 23*j* to the heat exchange fins 23*z* placed in the outermost edge of the outdoor heat exchanger 23. The second converging tube portion J2 extends from the end of the first converging tube portion J1 so as to pass through the plurality of heat exchange fins 23*z*. Similar to the second converging tube portion J2, the fourth converging tube portion J4 also extends so as to pass through the plurality of heat exchange fins 23*z*. The third converging tube portion J3 is a U-shaped tube which connects the second converging tube portion J2 and the fourth converging tube portion J4 in the end of the outdoor heat exchanger 23. During the air-cooling operation, since the flow of refrigerant in the refrigerant circuit 10 collects from a multiple split flow in the branched tube K into a single flow in the converging tube J, the refrigerant can collect into a single flow in the converging tube J even if the degree of subcooling degree of the refrigerant flowing through the branched tube K in the portion immediately before the converging/branching point 23*j* differs with each set of refrigerant flowing through the individual tubes constituting the branched tube K, and the degree of subcooling degree of the outlet of the outdoor heat exchanger 23 can therefore be adjusted. When the defrosting operation is performed during the air-warming operation, the hot gas bypass valve 27 is opened and high-temperature refrigerant discharged from the compressor 21 can be supplied to the converging tube J provided at the bottom end of the outdoor heat exchanger 23 before being supplied to the other portions of the outdoor heat exchanger 23. Therefore, ice deposited in the bottom vicinity of the outdoor heat exchanger 23 can be effectively thawed.

<1-5> Hot Gas Bypass Circuit H

Figure 8:
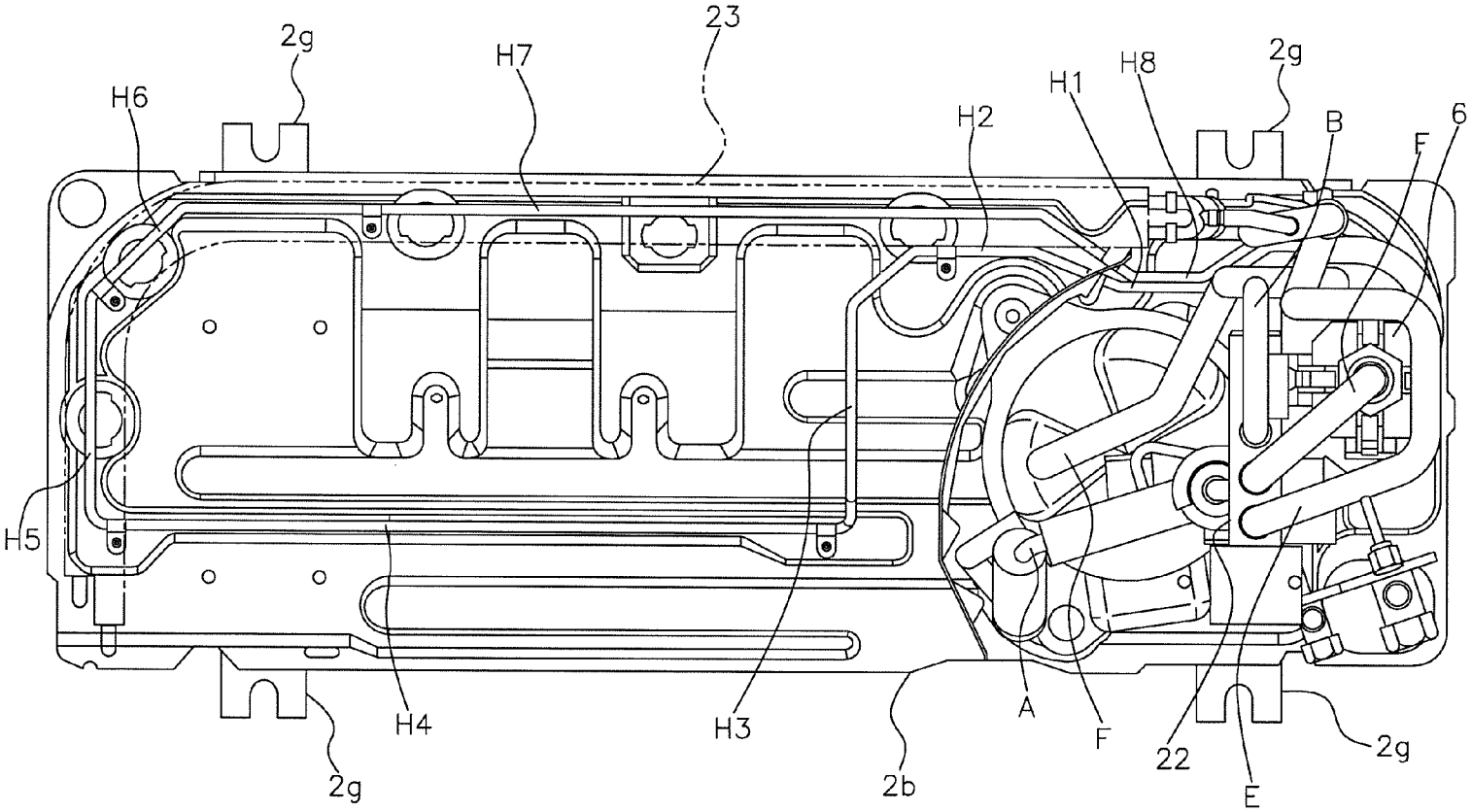
FIG. 8 is a plan view in which an air-blowing mechanism of the outdoor unit has been removed.
Figure 9:
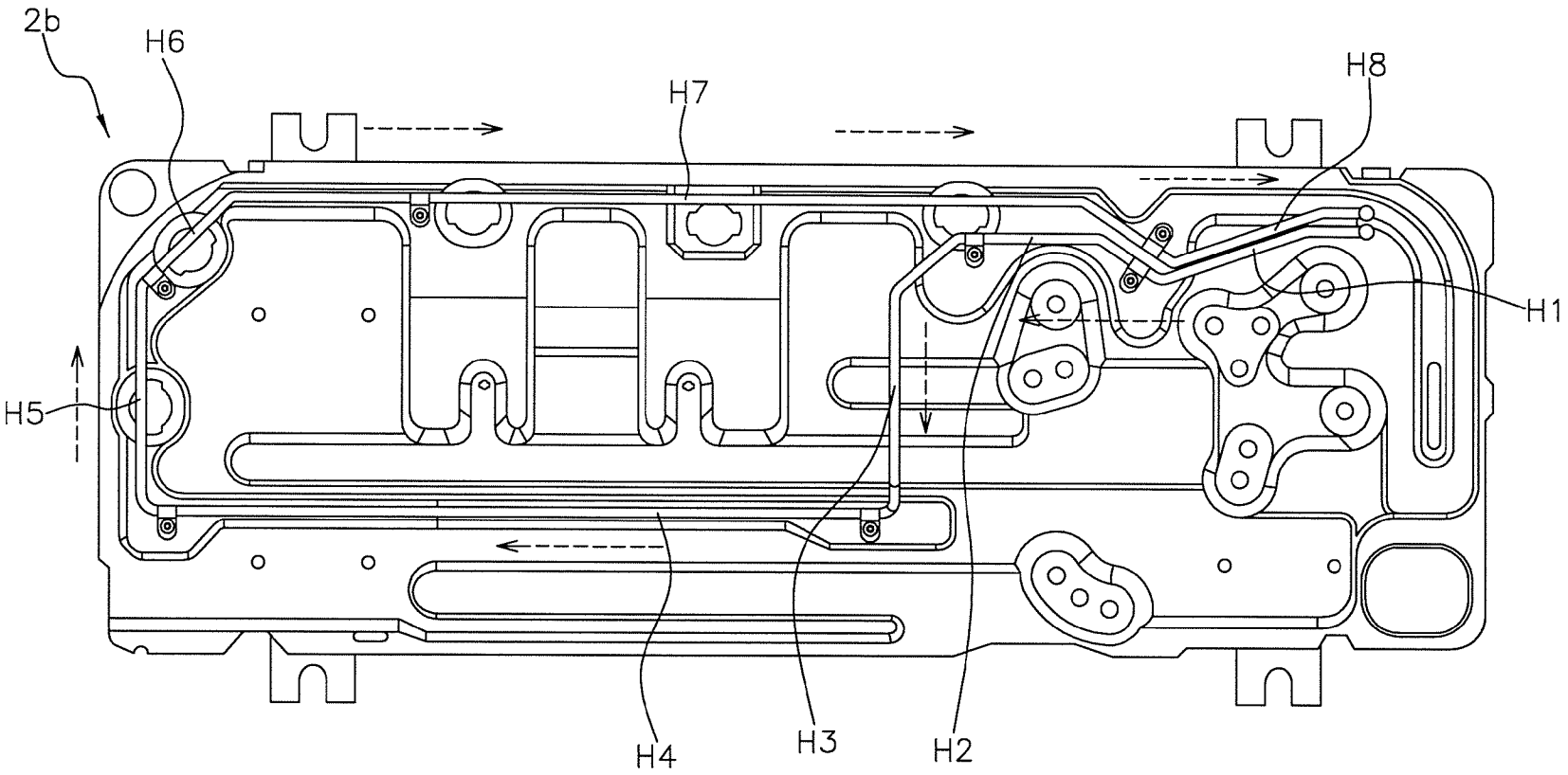
FIG. 9 is a plan view showing the placement relationship between the bottom plate of the outdoor unit and a hot gas bypass circuit.

FIG. 8 shows a plan view in which the air-blowing mechanism of the outdoor unit 2 has been removed. FIG. 9 shows a plan view of the placement relationship between the bottom plate of the outdoor unit 2 and the hot gas bypass circuit H.

The hot gas bypass circuit H has a first bypass portion H1 through to an eighth bypass portion H8 as shown in FIGS. 8 and 9, and also a ninth bypass portion H9 which is not shown. In the hot gas bypass circuit H, the portion that branches at the branching point A1 from the discharge tube A, extends to the hot gas bypass valve 27, and further extends from this hot gas bypass valve 27 is the first bypass portion H1. The second bypass portion H2 extends from the end of the first bypass portion H1 toward the air-blower chamber near the rear side. The third bypass portion H3 extends toward the front side from the end of the second bypass portion H2. The fourth bypass portion H4 extends in the opposite direction of the machine chamber, toward the left, from the end of the third bypass portion H3. The fifth bypass portion H5 extends toward the rear side from the end of the fourth bypass portion H4, up to a portion where a gap can be ensured from the rear side panel 2*e* of the outdoor unit casing. The sixth bypass portion H6 extends from the end of the fifth bypass portion H5 toward the machine chamber at the right and toward the rear side. The seventh bypass portion H7 extends from the end of the sixth bypass portion H6 toward the machine chamber at the right and through the inside of the air-blower chamber. The eighth bypass portion H8 extends through the inside of the machine chamber from the end of the seventh bypass portion H7. The ninth bypass portion H9 extends from the end of the eighth bypass portion H8 until it reaches the capillary tube 28. When the hot gas bypass valve 27 has been opened, refrigerant flows through the hot gas bypass circuit H in sequence from the first bypass portion H1 to the ninth bypass portion H9 as described above. Therefore, the refrigerant that branches at the branching point A1 of the discharge tube A extending from the compressor 21 flows to the first bypass portion H1 before the refrigerant flowing through the ninth bypass portion H9. Therefore, viewing the refrigerant flowing through the hot gas bypass circuit H as a whole, the refrigerant that has flowed through the fourth bypass portion H4 then continues to flow to the fifth through eighth bypass portions H8, the temperature of the refrigerant flowing through the fourth bypass portion H4 readily becomes higher than the temperature of the refrigerant flowing through the fifth through eighth bypass portions H8.

Thus, the hot gas bypass circuit H is placed in the bottom plate 2*b* of the outdoor unit casing so as to pass near the portion below the outdoor fans 26 and below the outdoor heat exchanger 23. Therefore, the vicinity of the portion where the hot gas bypass circuit H passes can be warmed by the high-temperature refrigerant branched and supplied from the discharge tube A of the compressor 21 without the use of a heater or another separate heat source. Consequently, even if the top side of the bottom plate 2*b* is wetted by rainwater or by drain water produced in the outdoor heat exchanger 23, the formation of ice can be suppressed in the bottom plate 2*b* below the outdoor fans 26 and below the outdoor heat exchanger 23. It is thereby possible to avoid situations in which the driving of the outdoor fans 26 is hindered by ice and situations in which the surface of the outdoor heat exchanger 23 is covered by ice, reducing heat exchange efficiency. The hot gas bypass circuit H is arranged so as to pass below the outdoor fans 26 after branching at the branching point A1 of the discharge tube A and before passing below the outdoor heat exchanger 23. Therefore, the formation of ice below the outdoor fans 26 can be prevented with greater priority.

<1-6> Electromagnetic Induction Heating Unit 6

Figure 10:
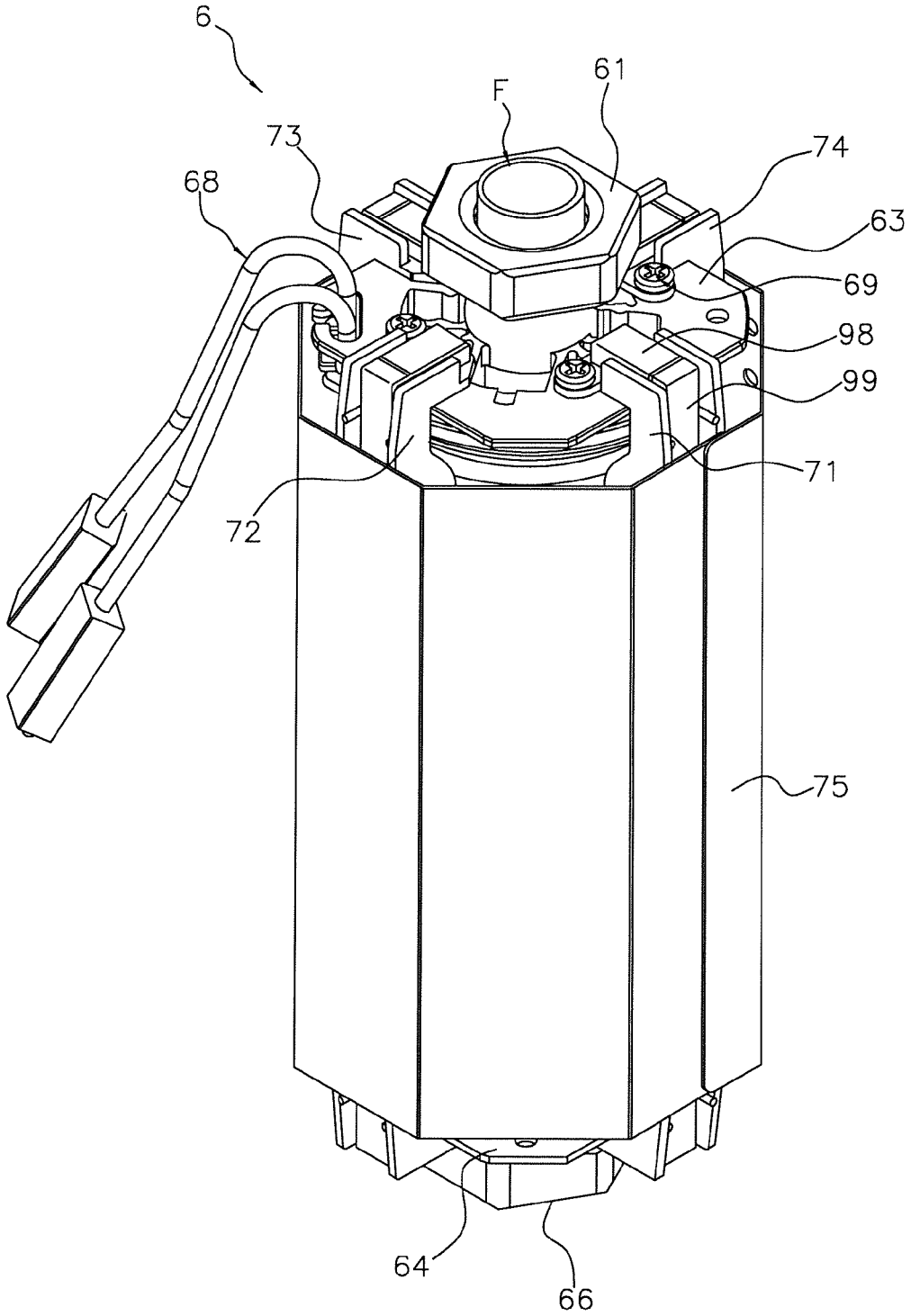
FIG. 10 is an external perspective view of an electromagnetic induction heating unit.
Figure 11:
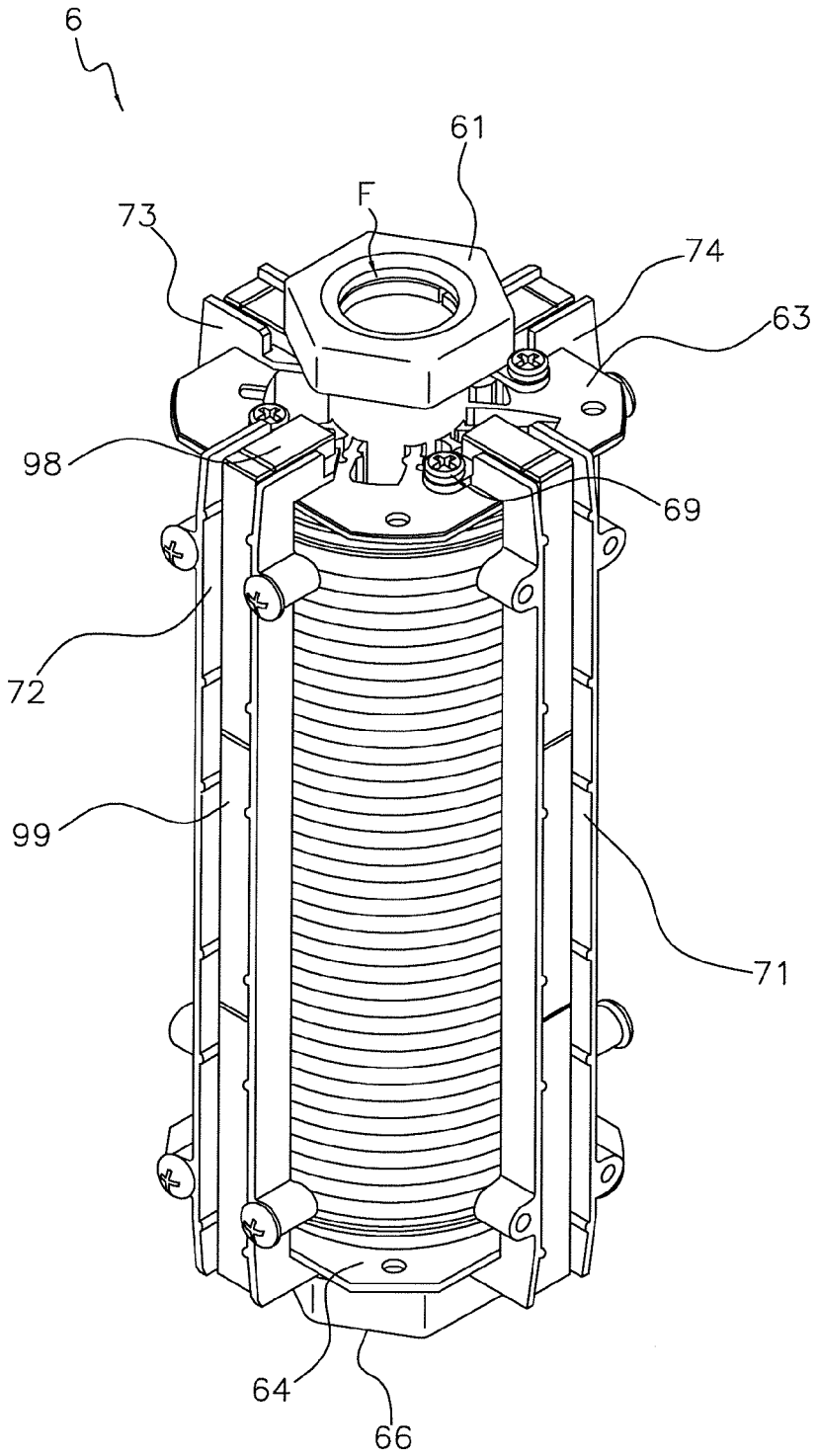
FIG. 11 shows an external perspective view showing a state in which a shielding cover has been removed from the electromagnetic induction heating unit.
Figure 12:
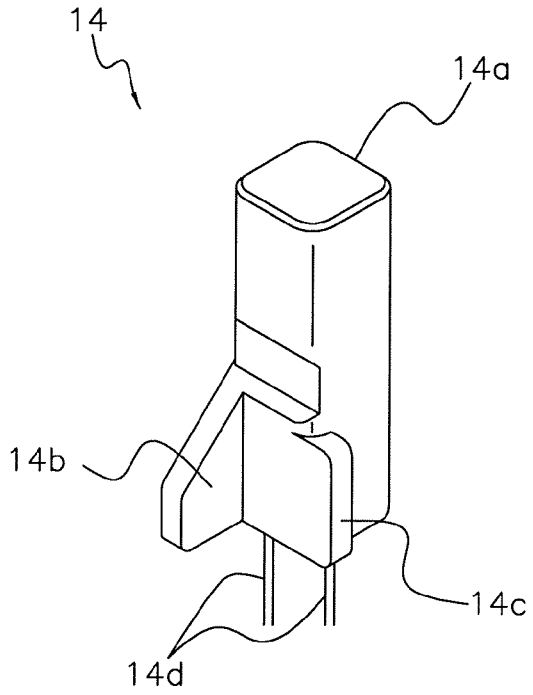
FIG. 12 is an external perspective view of an electromagnetic induction thermistor.

FIG. 10 shows a schematic perspective view of the electromagnetic induction heating unit 6 attached to the accumulation tube F. FIG. 11 shows an external perspective view in which a shielding cover 75 has been removed from the electromagnetic induction heating unit 6. FIG. 12 shows a cross-sectional view of the electromagnetic induction heating unit 6 attached to the accumulation tube F.

The electromagnetic induction heating unit 6 is placed so as to cover the magnetic tube F2 from the radially outer side, the magnetic tube F2 being the heat-generating portion of the accumulation tube F, and the magnetic tube F2 is made to generate heat by electromagnetic induction heating. This heat-generating portion of the accumulation tube F has a double-layered tube structure having a copper tube F1 on the inner side and a magnetic tube F2 on the outer side.

The electromagnetic induction heating unit 6 comprises a first hexagonal nut 61, a second hexagonal nut 66, a first bobbin cover 63, a second bobbin cover 64, a bobbin main body 65, a first ferrite case 71, a second ferrite case 72, a third ferrite case 73, a fourth ferrite case 74, a first ferrite 98 a second ferrite 99, a coil 68, the shielding cover 75, an electromagnetic induction thermistor 14, a fuse 15, and other components.

Figure 13:
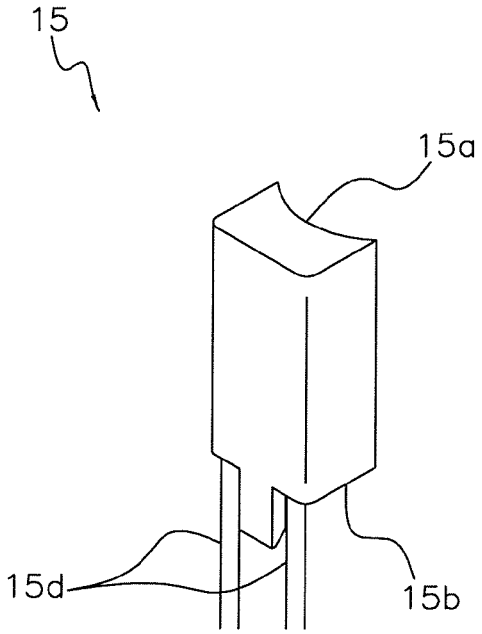
FIG. 13 is an external perspective view of a fuse.
Figure 14:
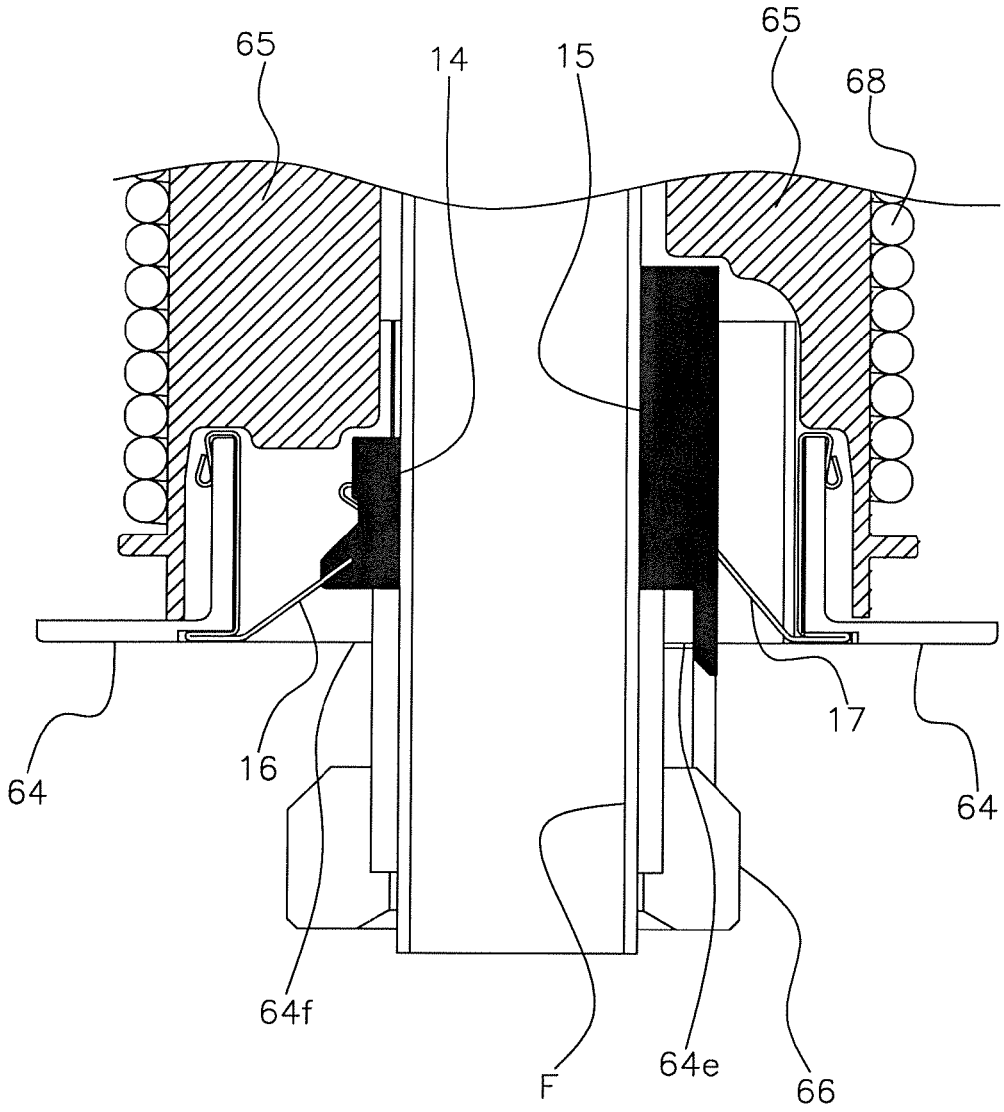
FIG. 14 is a schematic cross-sectional view showing the attached state of the electromagnetic induction thermistor and the fuse.
Figure 16:
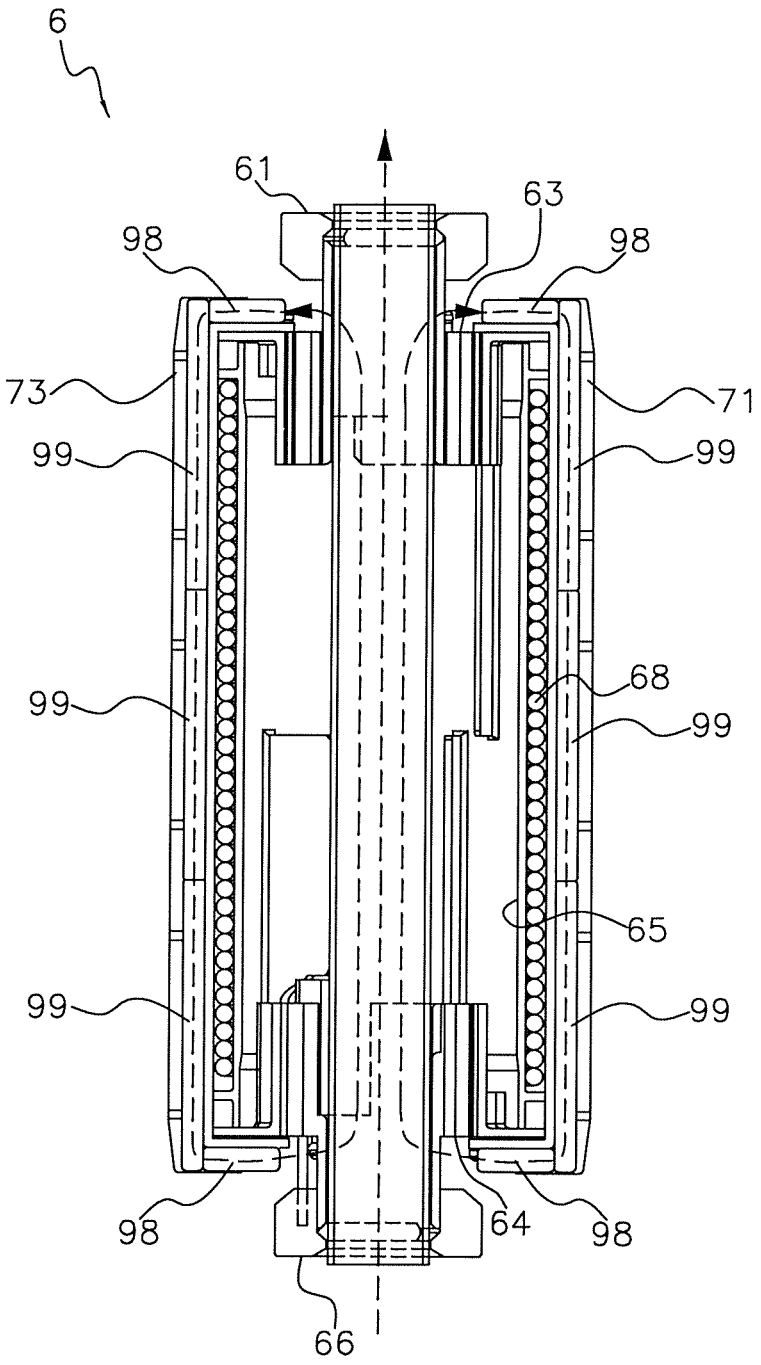
FIG. 16 is a drawing showing the details of a magnetic flux.

The first hexagonal nut 61 and the second hexagonal nut 66 are made of a resin, and are used to stabilize the fixed state between the electromagnetic induction heating unit 6 and the accumulation tube F with the aid of a C ring (not shown). The first bobbin cover 63 and the second bobbin cover 64 are made of a resin and are used to cover the accumulation tube F from the radially outer side in the top end position and bottom end position, respectively. The first bobbin cover 63 and the second bobbin cover 64 have four screw holes for screws 69, whereby the first through fourth first ferrite cases 71 to 74 described hereinafter are screwed in via the screws 69. Furthermore, the second bobbin cover 64 has an electromagnetic induction thermistor insertion opening 64F for inserting the electromagnetic induction thermistor 14 shown in FIG. 12 and attaching it to the outer surface of the magnetic tube F2. The second bobbin cover 64 also has a fuse insertion opening 64E for inserting the fuse 15 shown in FIG. 13 and attaching it to the outer surface of the magnetic tube F2. The electromagnetic induction thermistor 14 has an electromagnetic induction thermistor detector 14A, an outer projection 14B, a side projection 14C, and electromagnetic induction thermistor wires 14D for converting the detection result of the electromagnetic induction thermistor detector 14A to a signal and sending it to the control part 11, as shown in FIG. 12. The electromagnetic induction thermistor detector 14A has a shape that conforms to the curved shape of the outer surface of the accumulation tube F, and has a substantial contact surface area. The fuse 15 has a fuse detector 15A, an asymmetrical shape 15B, and fuse wires 15D for converting the detection result of the fuse detector 15A to a signal and sending it to the control part 11, as shown in FIG. 13. Having received from the fuse 15 a notification that a temperature exceeding a predetermined limit temperature has been detected, the control part 11 performs a control for stopping the supply of electricity to the coil 68, avoiding heat damage to the equipment. The bobbin main body 65 is made of a resin and the coil 68 is wound over the bobbin main body 65. The coil 68 is wound in a helical shape over the outer side of the bobbin main body 65, the axial direction being the direction in which the accumulation tube F extends. The coil 68 is connected to a control print board (not shown), and the coil receives the supply of high-frequency electric current. The output of the control print board is controlled by the control part 11. The electromagnetic induction thermistor 14 and the fuse 15 are attached in a state in which the bobbin main body 65 and the second bobbin cover 64 have been joined together, as shown in FIG. 14. When the electromagnetic induction thermistor 14 has been attached, a satisfactory state of pressure with the outer surface of the magnetic tube F2 is maintained by a plate spring 16 pushing radially inward on the magnetic tube F2. Similarly, in the attachment of the fuse 15, a satisfactory state of pressure with the outer surface of the magnetic tube F2 is maintained by a plate spring 17 pushing radially inward on the magnetic tube F2. Thus, since the electromagnetic induction thermistor 14 and the fuse 15 stay satisfactorily in firm contact with the outer surface of the accumulation tube F, responsiveness is improved and sudden temperature changes caused by electromagnetic induction heating can be quickly detected. By the first ferrite case 71, the first bobbin cover 63 and the second bobbin cover 64 are held in from the direction in which the accumulation tube F extends and are screwed in place by the screws 69. The first ferrite case 71 through to the fourth ferrite case 74 house the first ferrite 98 and the second ferrite 99, which are configured from the highly magnetically permeable material ferrite. The first ferrite 98 and the second ferrite 99 absorb the magnetic field created by the coil 68 and form a magnetic flux pathway, thereby impeding the magnetic field from leaking out to the exterior, as shown in the cross-sectional view of the accumulation tube F and electromagnetic induction heating unit 6 of FIG. 15 and the magnetic flux explanatory drawing of FIG. 16. The shielding cover 75 is placed around the outermost periphery of the electromagnetic induction heating unit 6, and collects an unattractable magnetic flux by the first ferrite 98 and the second ferrite 99 alone. The magnetic flux mostly does not leak out past the shielding cover 75, and the location where the magnetic flux is created can be determined arbitrarily.

<1-7> Electromagnetic Induction Heating Control

The electromagnetic induction heating unit 6 described above performs control for causing the magnetic tube F2 of the accumulation tube F to generate heat, during startup in which the air-warming operation is initiated when the refrigeration cycle is in the air-warming operation, during air-warming capability assistance, and during performing of the defrosting operation.

The description hereinbelow pertains to the time of startup.

Figure 17:
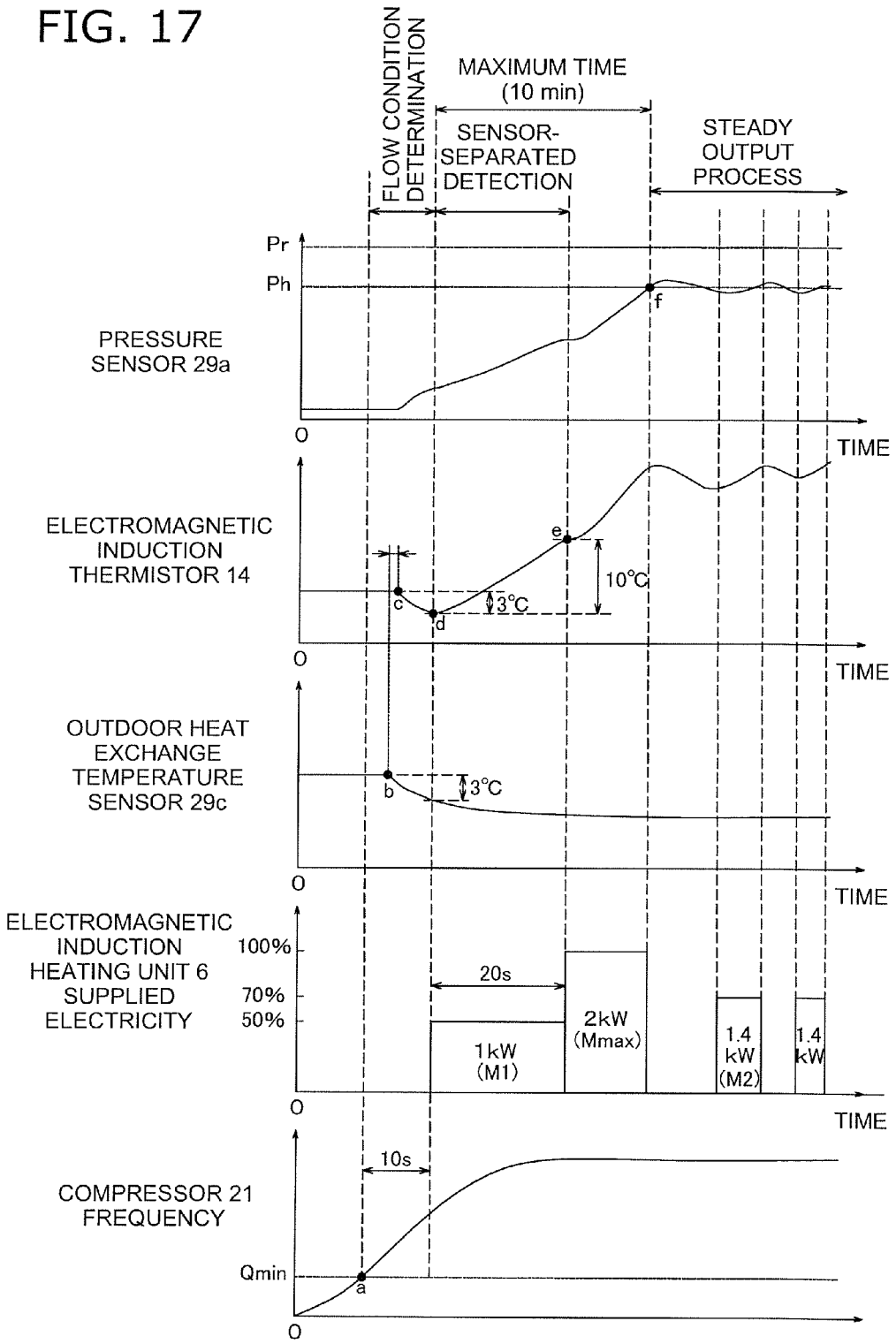
FIG. 17 is a view showing a time chart of electromagnetic induction heating control.

When an air-warming operation command is inputted to the controller 90 from the user, the control part 11 initiates the air-warming operation. When the air-warming operation is initiated, the control part 11 waits until the compressor 21 has started up and the pressure detected by the pressure sensor 29*a* has risen to 39 kg/cm$^2$, and then causes the indoor fan 42 to be driven. This prevents discomfort for the user due to unwarmed air flowing into the room in the stage at which the refrigerant passing through the indoor heat exchanger 41 has not yet been warmed. Electromagnetic induction heating using the electromagnetic induction heating unit 6 is performed here in order to shorten the time for the compressor 21 to start up and the pressure detected by the pressure sensor 29*a* to reach 39 kg/cm$^2$. During this electromagnetic induction heating, since the temperature of the accumulation tube F rises rapidly, prior to initiating electromagnetic induction heating, the control part 11 performs a control for determining whether or not conditions are suitable for initiating electromagnetic induction heating. Examples of such a determination include a flow condition determination process, a sensor-separated detection process, a rapid pressure-increasing process, and the like, as shown in the time chart of FIG. 17.

<1-8> Flow Condition Determination Process

When electromagnetic induction heating is performed, the heating load is only the refrigerant accumulating in the portion of the accumulation tube F where the electromagnetic induction heating unit 6 is attached while refrigerant is not flowing to the accumulation tube F. Thus, when electromagnetic induction heating by the electromagnetic induction heating unit 6 is performed while refrigerant is not flowing to the accumulation tube F, the temperature of the accumulation tube F rises abnormally to an extent such that the refrigerator oil deteriorates. The temperature of the electromagnetic induction heating unit 6 itself also rises, and the reliability of the equipment is reduced. Therefore, a flow condition determination process is performed herein which ensures that refrigerant flows to the accumulation tube F during a stage prior to initiating electromagnetic induction heating, so that electromagnetic induction heating by the electromagnetic induction heating unit 6 is not performed while refrigerant is not yet flowing to the accumulation tube F.

Figure 18:
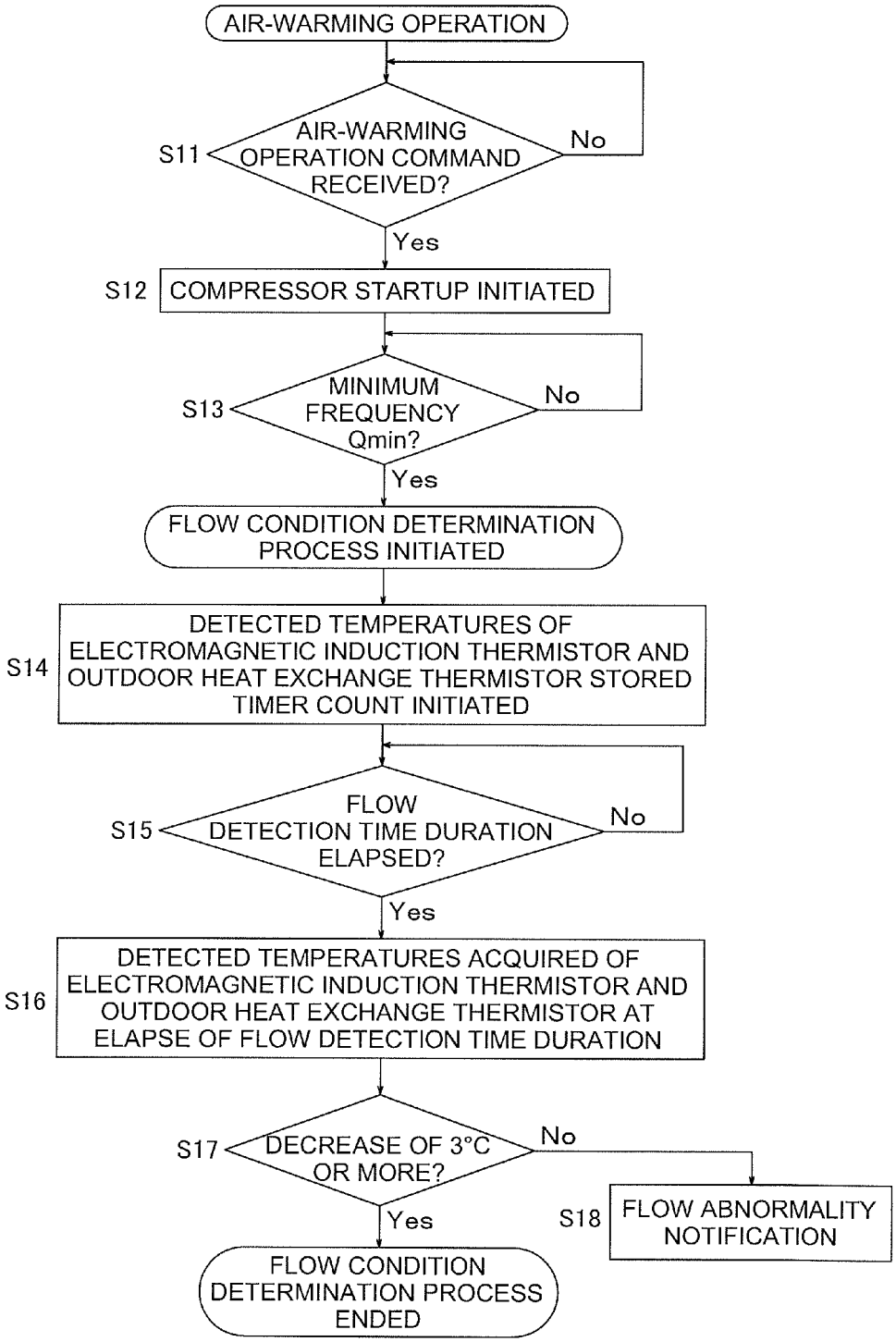
FIG. 18 is a view showing a flowchart of a flow condition determination process.

In the flow condition determination process, the following processes are performed as shown in the flowchart of FIG. 18.

In step S11, the control part 11 determines whether or not the controller 90 has received a command from the user for the air-warming operation and not for the air-cooling operation. Such a determination is made because the refrigerant must be heated by the electromagnetic induction heating unit 6 under the conditions in which the air-warming operation is performed.

In step S12, the control part 11 initiates startup of the compressor 21, and the frequency of the compressor 21 gradually increases.

In step S13, the control part 11 determines whether or not the frequency of the compressor 21 has reached a predetermined minimum frequency Qmin, and proceeds to step S14 when it has determined that the minimum frequency has been reached.

In step S14, the control part 11 initiates the flow condition determination process, stores detected temperature data of the electromagnetic induction thermistor 14 and detected temperature data of the outdoor heat exchange temperature sensor 29*c* at the time the frequency of the compressor 21 reached the predetermined minimum frequency Qmin (see point a in FIG. 17), and initiates a count of the flow detection time duration by the timer 95. When the frequency of the compressor 21 has not yet reached the predetermined minimum frequency Qmin, the refrigerant flowing through the accumulation tube F and the outdoor heat exchanger 23 is in a gas-liquid double phase and maintains a constant temperature at the saturation temperature, and the temperatures detected by the electromagnetic induction thermistor 14 and the outdoor heat exchange temperature sensor 29*c* are therefore constant and unchanging at the saturation temperature. However, the frequency of the compressor 21 continues to increase after some time, the refrigerant pressures in the outdoor heat exchanger 23 and in the accumulation tube F continue to further decrease, and the saturation temperature begins to decrease, whereby the temperatures detected by the electromagnetic induction thermistor 14 and the outdoor heat exchange temperature sensor 29*c* begin to decrease. Since the outdoor heat exchanger 23 herein is positioned farther downstream than the accumulation tube F in relation to the intake side of the compressor 21, the timing at which the refrigerant temperature in the outdoor heat exchanger 23 begins to decrease is earlier than the timing at which the refrigerant temperature in the accumulation tube F begins to decrease (see points b and c in FIG. 17).

In step S15, the control part 11 determines whether or not the flow detection time duration of 10 seconds has elapsed since the timer 95 began counting, and proceeds to step S16 when the flow detection time duration has elapsed. When the flow detection time duration has not yet elapsed, step S15 is repeated.

In step S16, the control part 11 acquires detected temperature data of the electromagnetic induction thermistor 14 and detected temperature data of the outdoor heat exchange temperature sensor 29*c* at the time that the flow detection time duration had elapsed and the refrigerant temperatures in the outdoor heat exchanger 23 and in the accumulation tube F had decreased, and then proceeds to step S17.

In step S17, the control part 11 determines whether or not the detected temperature of the electromagnetic induction thermistor 14 acquired in step S16 has fallen 3° C. or more below the detected temperature data of the electromagnetic induction thermistor 14 stored in step S14, and also determines whether or not the detected temperature of the outdoor heat exchange temperature sensor 29*c* acquired in step S16 has fallen 3° C. or more below the detected temperature data of the outdoor heat exchange temperature sensor 29*c* stored in step S14. Specifically, it is determined whether or not a decrease in the refrigerant temperature was successfully detected during the flow detection time duration. When either the detected temperature of the electromagnetic induction thermistor 14 or the detected temperature of the outdoor heat exchange temperature sensor 29*c* has fallen by 3° C. or more, it is determined that refrigerant is flowing through the accumulation tube F and a refrigerant flow has been ensured, the flow condition determination process is ended, and a transition is made either to the rapid pressure-increasing process during startup in which the output of the electromagnetic induction heating unit 6 is used at its maximum limit, to the sensor-separated detection process, or to another process.

On the other hand, when neither the detected temperature of the electromagnetic induction thermistor 14 nor the detected temperature of the outdoor heat exchange temperature sensor 29*c* has fallen by 3° C. or more, the process transitions to step S18.

In step S18, the control part 11 assumes that the quantity of refrigerant flowing through the accumulation tube F is insufficient for induction heating by the electromagnetic induction heating unit 6, and the control part 11 outputs a flow abnormality display on the display screen of the controller 90.

<1-9> Sensor-Separated Detection Process

The sensor-separated detection process is a process for confirming the attached state of the electromagnetic induction thermistor 14, and is performed after the electromagnetic induction thermistor 14 is attached to the accumulation tube F and the air conditioning apparatus 1 is finished being installed (after installation is finished, including after the breaker supplying electricity to the electromagnetic induction heating unit 6 has tripped), when the air-warming operation is first initiated. Specifically, the control part 11 performs the sensor-separated detection process after it has determined in the above-described flow condition determination process that the flow quantity of refrigerant in the accumulation tube F has been ensured, and before performing the rapid pressure-increasing process during startup in which the output of the electromagnetic induction heating unit 6 is used at its maximum limit.

When the air conditioning apparatus 1 is being transported, unanticipated vibrations and the like can cause the attached state of the electromagnetic induction thermistor 14 to be unstable or to come apart, and when a newly transported electromagnetic induction heating unit 6 is operated for the first time, its reliability in particular is required, and when a newly transported electromagnetic induction heating unit 6 operates for the first time in the proper manner, it can be estimated, to a certain extent, that subsequent operations will be stable. Therefore, the sensor-separated detection process is performed with the timing described above.

Figure 19:
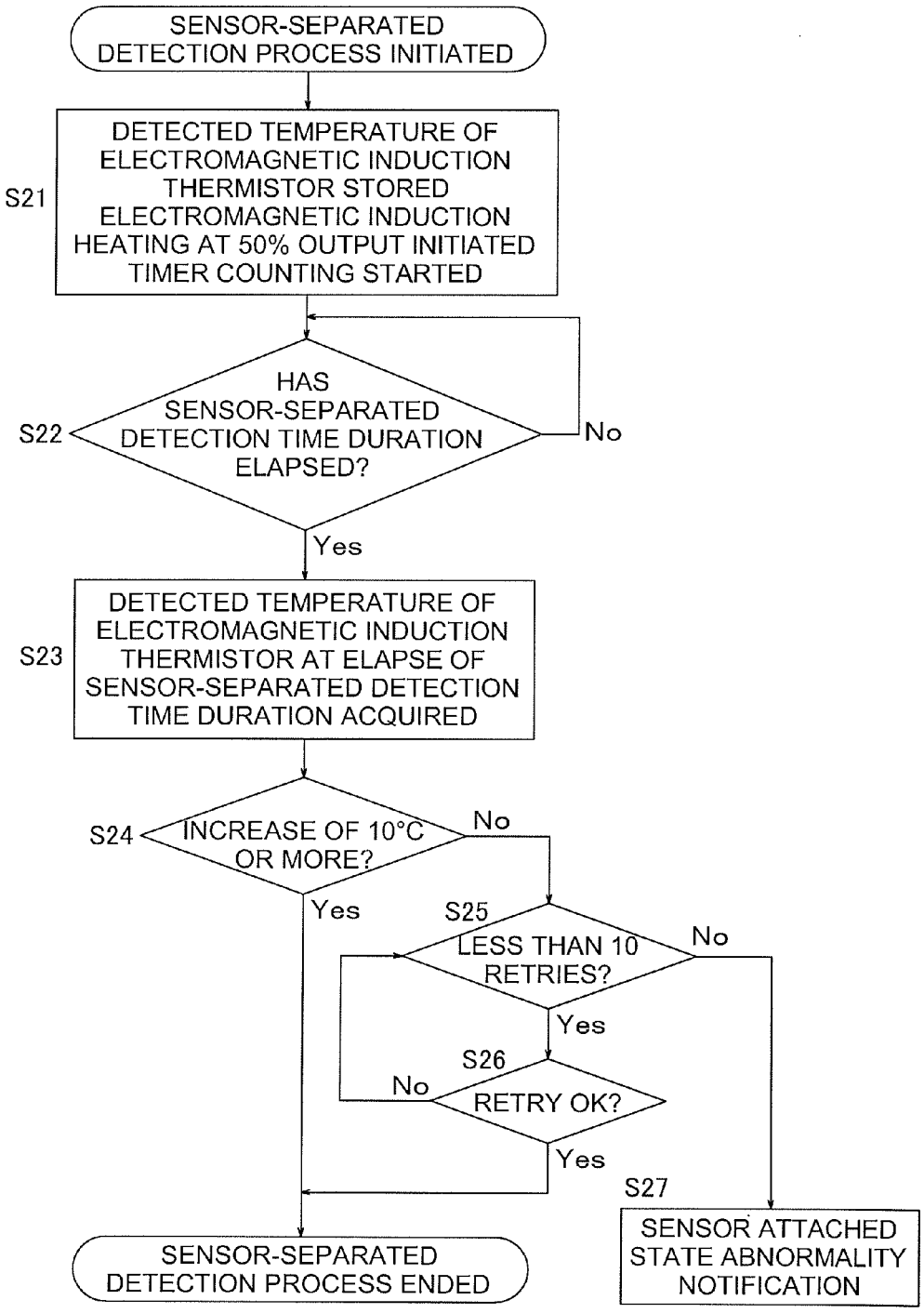
FIG. 19 is a view showing a flowchart of a sensor-separated detection process.

In the sensor-separated detection process, the following processes are performed as shown in the flowchart of FIG. 19.

In step S21, the control part 11 ensures either the refrigerant flow quantity in the accumulation tube F that was confirmed by the flow condition determination process or a greater refrigerant flow quantity, stores detected temperature data of the electromagnetic induction thermistor 14 (see point d in FIG. 17) at the time the flow detection time duration ended (=starting time point of the sensor-separated detection time duration), and initiates the supply of electricity to the coil 68 of the electromagnetic induction heating unit 6. Electricity is supplied to the coil 68 of the electromagnetic induction heating unit 6 here for the sensor-separated detection time duration of 20 seconds, at a separated detection supplied electricity M1 (1 kW) of an output 50% less than a predetermined maximum supplied electricity Mmax (2 kW). In this stage, since the attached state of the electromagnetic induction thermistor 14 is not yet confirmed to be satisfactory, the output is reduced to 50% regardless of any abnormal rise in temperature in the accumulation tube F, so that the fuse 15 will not be damaged and the resinous components of the electromagnetic induction heating unit 6 will not melt due to the electromagnetic induction thermistor 14 being unable to detect this abnormal rise in temperature. At the same time, the continuous heating time duration of the electromagnetic induction heating unit 6 is set in advance so as not to exceed the maximum continuous output time duration of 10 minutes, and the control part 11 therefore causes the timer 95 to begin counting the elapsed time duration in which the electromagnetic induction heating unit 6 continues to output. The supply of electricity to the coil 68 of the electromagnetic induction heating unit 6 and the magnitude of the magnetic field generated by the coil 68 around itself are correlated values.

In step S22, the control part 11 determines whether or not the sensor-separated detection time duration has ended. When the sensor-separated detection time duration has ended, the process transitions to step S23. When the sensor-separated detection time duration has not yet ended, step S22 is repeated.

In step S23, the control part 11 acquires the detected temperature of the electromagnetic induction thermistor 14 at the point in time when the sensor-separated detection time duration ended (point e of FIG. 17), and the process transitions to step S24.

In step S24, the control part 11 determines whether or not the detected temperature of the electromagnetic induction thermistor 14 at end of the sensor-separated detection time duration acquired in step S23 has risen 10° C. or more above the detected temperature data of the electromagnetic induction thermistor 14 at the start of the sensor-separated detection time duration stored in step S21. Specifically, a determination is made as to whether or not the refrigerant temperature has risen by 10° C. or more due to the induction heating by the electromagnetic induction heating unit 6 during the sensor-separated detection time duration. When the detected temperature of the electromagnetic induction thermistor 14 has risen by 10° C. or more, it is determined that it was successfully confirmed that the attached state of the electromagnetic induction thermistor 14 to the accumulation tube F is satisfactory and that the accumulation tube F has been appropriately warmed by the induction heating of the electromagnetic induction heating unit 6, the sensor-separated detection process is ended, and the process transitions to the rapid pressure-increasing process at startup in which the output of the electromagnetic induction heating unit 6 is used to its maximum limit. When the detected temperature of the electromagnetic induction thermistor 14 has not risen by 10° C. or more, the process transitions to step S25.

In step S25, the control part 11 counts the number of times a sensor-separated retry process was performed. When the number of retries is less than ten, the process transitions to step S26, and when the number of retries exceeds ten, the process transitions to step S27 without transitioning to step S26.

In step S26, the control part 11 performs the sensor-separated retry process. Herein the detected temperature data of the electromagnetic induction thermistor 14 at elapse of 30 more seconds (not shown in FIG. 17) is stored, electricity is supplied at a separated detection supplied electricity M1 to the coil 68 of the electromagnetic induction heating unit 6 for 20 seconds, the same processes of steps S22 and S23 are performed, the sensor-separated detection process is ended when the detected temperature of the electromagnetic induction thermistor 14 has risen by 10° C. or more, and the process transitions to the rapid pressure-increasing process at startup in which the output of the electromagnetic induction heating unit 6 is used to its maximum limit. When the detected temperature of the electromagnetic induction thermistor 14 has not risen by 10° C. or more, the process returns to step S25.

In step S27, the control part 11 determines that the attached state of the electromagnetic induction thermistor 14 to the accumulation tube F is unstable or unsatisfactory, and outputs a sensor-separated abnormality display on the display screen of the controller 90.

<1-10> Rapid Pressure-Increasing Process

The control part 11 initiates the rapid pressure-increasing process in a state in which flow condition determination process and the sensor-separated detection process have ended, it was confirmed that sufficient refrigerant flow in the accumulation tube F has been ensured, the attached state of the electromagnetic induction thermistor 14 to the accumulation tube F is satisfactory, and the accumulation tube F has been appropriately warmed by induction heating by the electromagnetic induction heating unit 6.

Even if induction heating by the electromagnetic induction heating unit 6 is performed here at high output, the reliability of the air conditioning apparatus 1 is successfully improved because it is confirmed that there is no abnormal rise in temperature in the accumulation tube F.

Figure 20:
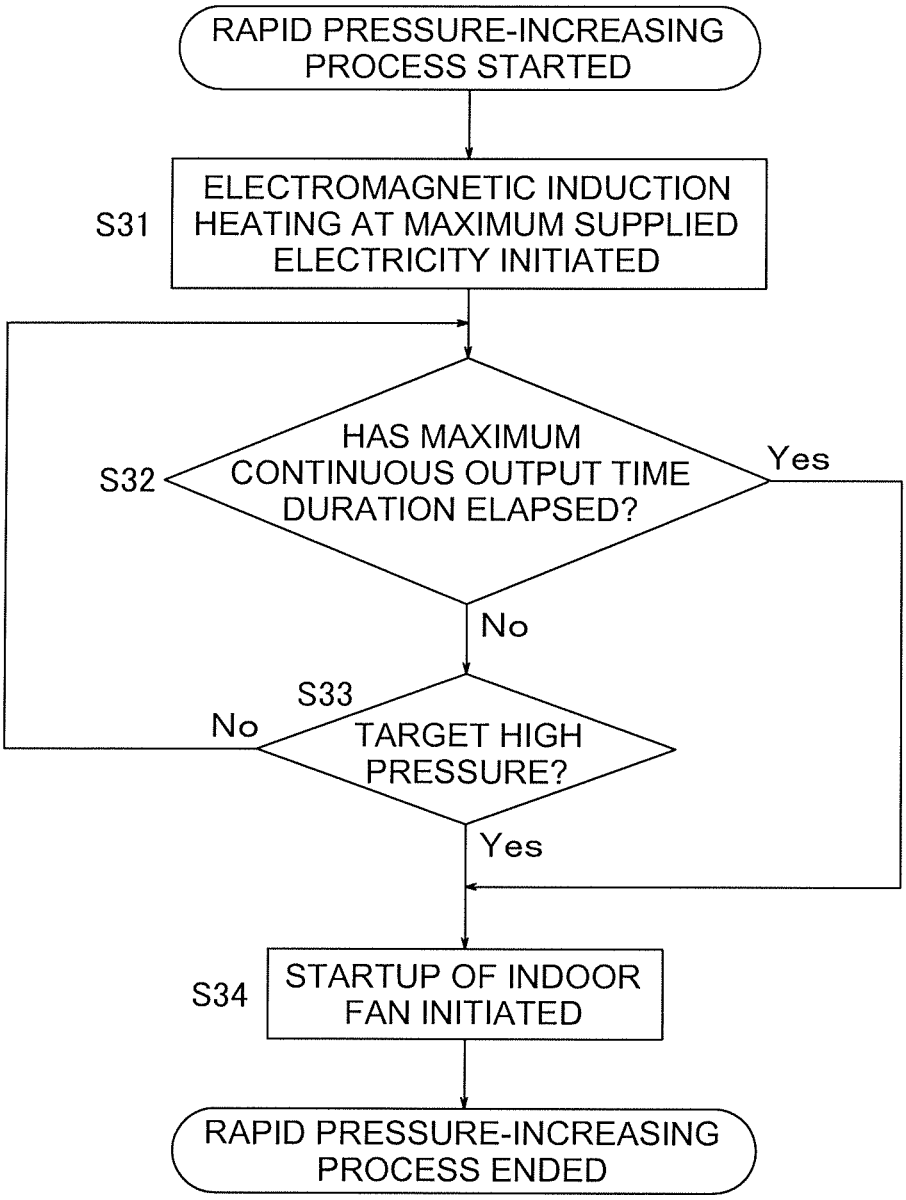
FIG. 20 is a view showing a flowchart of a rapid pressure-increasing process.

In the rapid pressure-increasing process, the following processes are performed as shown in FIG. 20.

In step S31, the control part 11 sets the supply of electricity to the coil 68 of the electromagnetic induction heating unit 6 not to the separated detected supplied electricity M1 limited to 50% output as it was during the sensor-separated detection process described above, but rather to the predetermined maximum supplied electricity Mmax (2 kW). This output by the electromagnetic induction heating unit 6 is continued until the pressure sensor 29*a* reaches a predetermined target high pressure Ph.

To prevent abnormal high-pressure increases in the refrigeration cycle of the air conditioning apparatus 1, the control part 11 forces the compressor 21 to stop when the pressure sensor 29*a* detects an abnormally high pressure Pr. The predetermined target high pressure Ph during this rapid pressure-increasing process is provided as a separate threshold that is a pressure value smaller than the abnormally high pressure Pr.

In step S32, the control part 11 determines whether or not the maximum continuous output time duration of 10 minutes of the electromagnetic induction heating unit 6 has elapsed since the start of the count in step S21 of the sensor-separated detection process. If the maximum continuous output time duration has not elapsed, the process advances to step S33. If the maximum continuous output time duration has elapsed, the process advances to step S34.

In step S33, the control part 11 determines whether or not the detected pressure of the pressure sensor 29*a* has reached the target high pressure Ph. If the target high pressure Ph has been reached, the process transitions to step S34. If the target high pressure Ph has not been reached, step S32 is repeated.

In step S34, the control part 11 initiates driving of the indoor fan 42, ends the rapid pressure-increasing process, and transitions to a steady output process.

When the process advances herein from step S33 to step S34, the indoor fan 42 begins to operate under conditions in which sufficiently warm conditioned air can be successfully being supplied to the user. When the process advances from step S32 to step S34, a state of successfully supplying the user with sufficiently warm conditioned air has not been reached, but conditioned air that is somewhat warm can be supplied and the supply of warm air can be initiated in a range whereby the elapsed time since the start of the air-warming operation is not too long.

<1-11> Steady Output Process

In the steady output process, a steadily supplied electricity M2 (1.4 kW), which is equal to or greater than the separated detected supplied electricity M1 (1 kW) and equal to or less than the maximum supplied electricity Mmax (2 kW), is designated as a fixed output value, and the frequency of electricity supply to the electromagnetic induction heating unit 6 is PI controlled so that the detected temperature of the electromagnetic induction thermistor 14 is maintained at the startup target accumulation tube temperature of 80° C.

Figure 21:
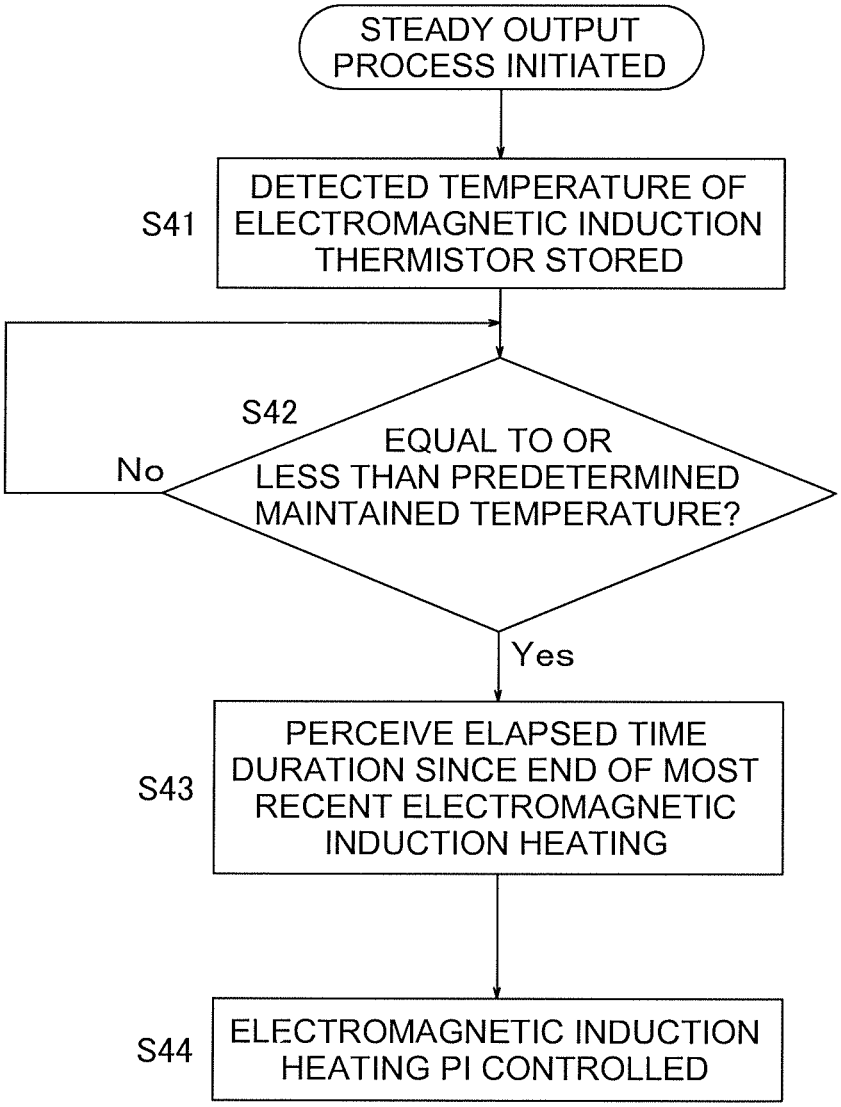
FIG. 21 is a view showing a flowchart of a steady output process.

In the steady output process, the following processes are performed as shown in the flowchart of FIG. 21.

In step S41, the control part 11 stores the detected temperature of the electromagnetic induction thermistor 14 and transitions to step S42.

In step S42, the control part 11 compares the detected temperature of the electromagnetic induction thermistor 14 stored in step S41 with the startup target accumulation tube temperature of 80° C., and determines whether or not the detected temperature of the electromagnetic induction thermistor 14 is equal to or less than a predetermined maintained temperature that is lower than the startup target accumulation tube temperature of 80° C. by a predetermined temperature. If the detected temperature is equal to or less than the predetermined maintained temperature, the process transitions to step S43. If the detected temperature is not equal to or less than the predetermined maintained temperature, the process waits continuously until the detected temperature is equal to or less than the predetermined maintained temperature.

In step S43, the control part 11 perceives the elapsed time since the end of the most recent supply of electricity to the electromagnetic induction heating unit 6.

In step S44, the control part 11 designates one set as the continuous supply of electricity to the electromagnetic induction heating unit 6 while constantly maintaining the steadily supplied electricity M2 (1.4 kW) for 30 seconds, and performs PI control in which the frequency of this set is increased to a higher frequency the longer the elapsed time perceived in step S43.

<Characteristics of Air Conditioning Apparatus 1 of Present Embodiment>

In the air conditioning apparatus 1, the flow condition determination process for confirming that refrigerant is flowing to the accumulation tube F is performed prior to induction heating of the accumulation tube F by the electromagnetic induction heating unit 6. Induction heating using the electromagnetic induction heating unit 6 is then performed while maintaining a flow quantity equal to or greater than the refrigerant flow quantity confirmed in the flow condition determination process. Therefore, induction heating by the electromagnetic induction heating unit 6 is prevented from being performed while refrigerant is not flowing to the accumulation tube F, and it is possible to minimize damage due to the accumulation tube F, the electromagnetic induction heating unit 6, the fuse 15, the electromagnetic induction thermistor 14, or other components being exposed to high temperatures, and also to minimize deterioration of refrigeration oil.

In the flow condition determination process, it is possible to confirm that the detected temperature has decreased. Therefore, even if induction heating by the electromagnetic induction heating unit 6 is performed after a flow has been confirmed by this flow condition determination process, the target portion of induction heating does not undergo a further temperature increase due to the flow of refrigerant, but rather the extent of the temperature increase in this portion is suppressed due to the flow of refrigerant. The reliability of induction heating using the electromagnetic induction heating unit 6 of the air conditioning apparatus 1 can be improved from this respect as well.

When electromagnetic induction heating is generally, performed, sudden temperature increases occur more readily than temperature increases caused by changes in the refrigerant circulation conditions in the refrigeration cycle. As a countermeasure to this, in the electromagnetic induction heating unit 6 of the air conditioning apparatus 1, the electromagnetic induction thermistor 14, which is pressed against the magnetic tube F2 by the elastic force of the plate spring 16, maintains satisfactory responsiveness to rapid temperature changes caused by electromagnetic induction heating during the above-described sensor-separated detection process in which temperature changes caused by electromagnetic induction heating are detected. Therefore, the responsiveness of the flow condition determination process can be satisfactory, and the time duration required until the process is ended can be shortened.

Other Embodiments

Embodiments of the present invention were described above based on the drawings, but the specific configuration is not limited to these embodiments, and modifications can be made within a range that does not deviate from the scope of the invention.

(A)

In the embodiment described above, an example was described of a case in which in step S14 of the flow condition determination process, the control part 11 stored the detected temperature data of the electromagnetic induction thermistor 14 and the detected temperature data of the outdoor heat exchange temperature sensor 29*c*, which are saturation temperatures, at the time the frequency of the compressor 21 reached the predetermined minimum frequency Qmin (see point a in FIG. 17), and it was confirmed that a flow was ensured on the condition that the subsequent decrease in the detected temperatures was detected.

However, the present invention is not limited to this example.

In another option, for example, a comparison is made between the detected temperature of the electromagnetic induction thermistor 14 or the detected temperature of the outdoor heat exchange temperature sensor 29*c* while the compressor 21 is being driven at a predetermined first frequency greater than the predetermined minimum frequency Qmin, and the detected temperature data of the electromagnetic induction thermistor 14 and the detected temperature data of the outdoor heat exchange temperature sensor 29*c* while the frequency o the compressor 21 has been raised to a second frequency higher than the first frequency; and it is confirmed that a flow is ensured on the condition that the temperature decreases be detected. The compressor 21 operating at the first frequency herein may also be in a stopped state, for example.

(B)

In the embodiment described above, an example was described of a case in which a determination was made of whether or not a refrigerant flow was ensured, focusing on changes in the detected temperature of the electromagnetic induction thermistor 14 which detected the temperature of the magnetic tube F2 constituting the outer side of the accumulation tube F.

However, the present invention is not limited to this example.

In another option, for example, the refrigerant flow is confirmed by using a detection device of bimetal or the like for detecting if the temperature is greater than a predetermined temperature or less than a predetermined temperature and setting the predetermined temperature of the detection device to a value between the temperature prior to the sensor-separated detection process and the subsequent temperature. In this case, even if it is not possible to detect the specific temperature when the flow condition determination process is performed, the flow state can be confirmed by detecting the temperature change.

(C)

In the embodiment described above, an example was described of a case in which it was determined that the refrigerant flow has been confirmed and the flow condition determination process was ended when the refrigerant temperature had fallen by 3° C. or more during the flow detection time duration.

However, the present invention is not limited to this example.

In another option, for example, it is determined that the refrigerant flow has been confirmed and the flow condition determination process is ended not after waiting for the elapse of 10 seconds, which was described as the flow detection time duration, but at the point in time when a decrease of a predetermined temperature (e.g. 3° C.) was detected. In this case, the flow condition determination process can be ended sooner and warm conditioned air can begin to be provided to the user at an earlier timing without waiting for the elapse of the flow detection time duration of 10 seconds.

(D)

In the embodiment described above, an example of a case was described in which whether or not the refrigerant was flowing was confirmed in the flow condition determination process by detecting the temperature decrease on the intake side of the compressor 21 with the frequency of the compressor 21 having been raised to the predetermined minimum frequency Qmin or higher.

However, the present invention is not limited to this example.

In another option, for example, in the flow condition determination process, control is performed for narrowing the degree of opening of the outdoor electric expansion valve 24 with the frequency of the compressor 21 having been raised to the predetermined minimum frequency Qmin or higher. In this case, since the refrigerant quantity passing through the outdoor electric expansion valve 24 is minimized, the refrigerant pressure of the outdoor heat exchanger 23 or the accumulation tube F decreases more quickly, and the temperature decrease also occurs sooner. Therefore, the flow condition determination process, the sensor-separated detection process, and other confirming operations can be ended more quickly, and the timing at which warm conditioned air is provided to the user can be sooner.

For the narrowed degree of opening of the outdoor electric expansion valve 24 herein, the degree of opening may be used which is narrower than the degree of opening of the outdoor electric expansion valve 24 during subcooling degree constant control such as is described below, for example. In subcooling degree constant control, when the control at the startup of the air-warming operation has ended and a usual state is in effect, for example, control for adjusting the degree of opening of the outdoor electric expansion valve 24 is performed in order to make constant the subcooling degree of the refrigerant flowing from the outdoor heat exchanger 23 to the outdoor electric expansion valve 24. The degree of opening of the outdoor electric expansion valve 24 when the flow condition determination process is performed herein is narrowed so as to be smaller than the degree of opening of the outdoor electric expansion valve 24 when this subcooling degree constant control is being performed. Specifically, the degree of opening is compared with and made smaller than the degree of opening of the outdoor electric expansion valve 24 adjusted when subcooling degree constant control is performed under certain operating conditions during the flow condition determination process; conditions such as the indoor temperature and outdoor temperature, the frequencies of the outdoor fans 26, the indoor fan 42, and the compressor 21, etc. It is thereby possible to achieve the above-described operational effect of more quickly reducing the refrigerant pressure in the outdoor heat exchanger 23 and the accumulation tube F.

(E)

In the embodiment described above, an example of a case was described in which either the outdoor heat exchanger 23 or the accumulation tube F was the target for the location where the temperature decrease was detected during the flow condition determination process.

However, the present invention is not limited to this example.

In another option, for example, for the location where the temperature change during the flow condition determination process is detected, the detection target is the vicinity upstream of the outdoor heat exchanger 23 (the side of the outdoor heat exchanger 23 that faces to the outdoor electric expansion valve 24), or the vicinity downstream of the indoor heat exchanger 41 (between the compressor 21 and the indoor heat exchanger 41).

(F)

In the embodiment described above, an example was described of a case in which control was performed for determining whether or not there was a change in the detected temperature of the electromagnetic induction thermistor 14 or the outdoor heat exchange temperature sensor 29*c* in the flow condition determination process.

However, the present invention is not limited to this example.

For example, when the flow condition determination process is performed, the capability of the indoor heat exchanger 41, the capability of the outdoor heat exchanger 23, the degree of opening of the outdoor electric expansion valve 24, or any other condition can be fixed instead of performing control for increasing the frequency of the compressor 21, whereby causes other than the frequency of the compressor 21 can be reduced as much as possible, and it is possible to more accurately perceive that changes in the detected temperature of the electromagnetic induction thermistor 14 or the outdoor heat exchange temperature sensor 29*c* are caused by changes in the frequency of the compressor 21. The capability of the indoor heat exchanger 41, the capability of the outdoor heat exchanger 23, and the degree of opening of the outdoor electric expansion valve 24 herein are not limited to being maintained at predetermined values, and they may also be maintained within ranges having predetermined widths small enough to be ignored in comparison with the effects of changes in the frequency of the compressor 21, for example.

(G)

In the embodiment described above, an example was described of a case in which the electromagnetic induction heating unit 6 was attached to the accumulation tube F within the refrigerant circuit 10.

However, the present invention is not limited to this example.

For example, another refrigerant tube other than the accumulation tube F may be provided. In this case, the magnetic tube F2 or another magnetic component is provided to the refrigerant tube portion provided with the electromagnetic induction heating unit 6.

(H)

In the embodiment described above, an example was described of a case in which the flow of refrigerant to the accumulation tube F portion of the refrigerant circuit 10 was confirmed by perceiving the change in the detected temperature of the electromagnetic induction thermistor 14 attached to the accumulation tube F, and induction heating by the electromagnetic induction heating unit 6 was initiated after this confirmation.

However, the present invention is not limited to this example.

For example, the flow of refrigerant to the accumulation tube F portion of the refrigerant circuit 10 may be confirmed by perceiving a change in the pressure detected by a pressure sensor, or by perceiving that a predetermined pressure has been reached or exceeded. A possible example of such a pressure sensor is one that detects at least one of the refrigerant pressures in the discharge side or intake side of the compressor. When the refrigerant pressure in the discharge side of the compressor is perceived, the refrigerant flow can be confirmed by perceiving that the detected refrigerant pressure has risen after the compressor has been started up. When the refrigerant pressure in the intake side of the compressor is perceived, the refrigerant flow can be confirmed by perceiving that the detected refrigerant pressure has decreased after the compressor has been started up.

Figure 22:
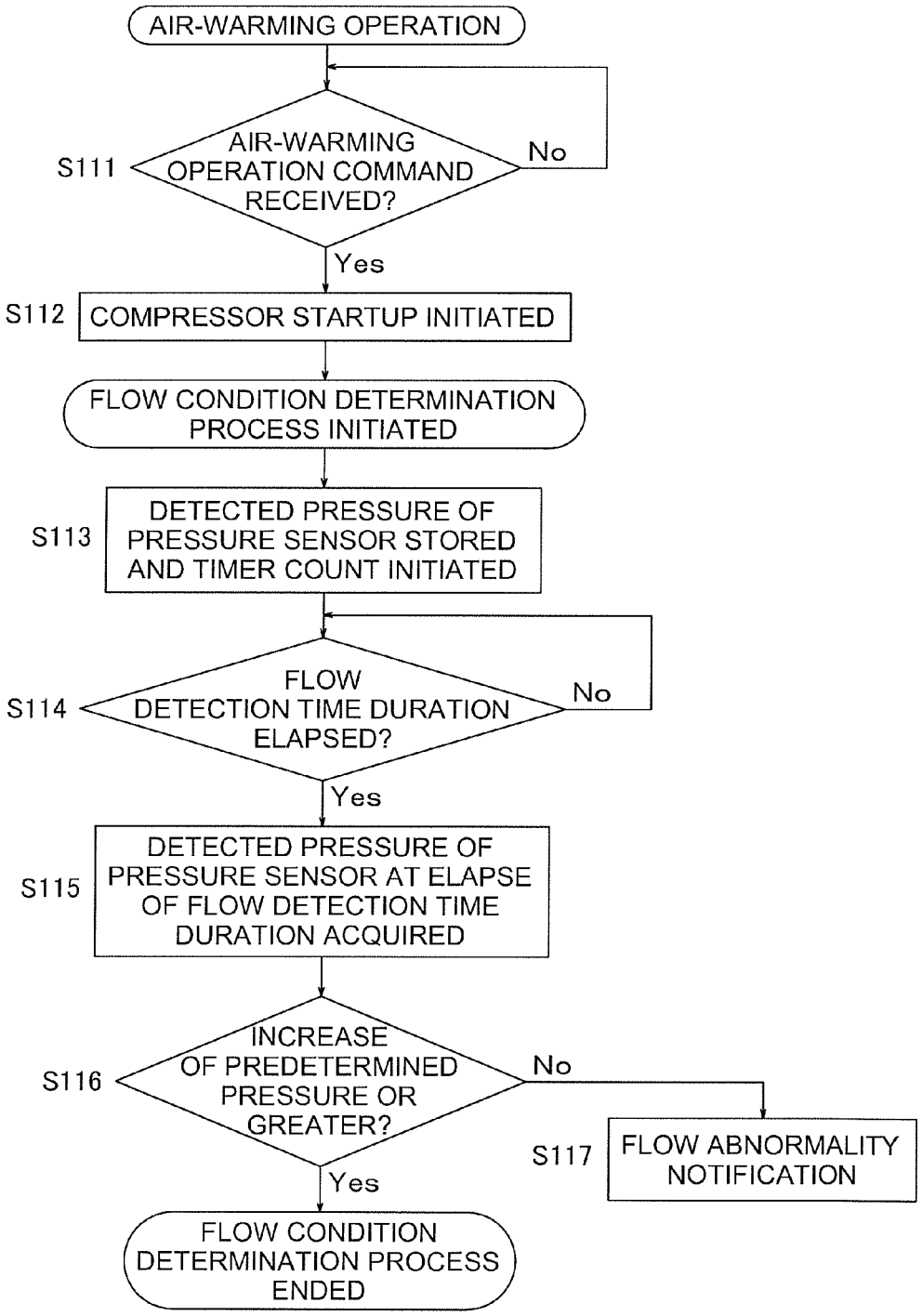
FIG. 22 is a flowchart showing an example in which the refrigerant flow is perceived using a pressure sensor of another embodiment (H).

In the embodiment described above, the flow of refrigerant to the accumulation tube F portion may be confirmed either by perceiving a detection value of the pressure sensor 29*a* which detects the refrigerant pressure flowing through the indoor-side gas tube B (the refrigerant tube connecting the discharge side of the compressor 21 and the indoor heat exchanger 41), or by perceiving a change in this detection value. The process that uses such a pressure sensor 29*a* is described hereinbelow with the flowchart of FIG. 22.

Herein is an example in which the flow condition determination process of confirming the flow of refrigerant to the accumulation tube F prior to initiating electromagnetic induction heating is performed using the pressure sensor 29*a*, so that electromagnetic induction heating by the electromagnetic induction heating unit 6 is not performed while refrigerant is not flowing to the accumulation tube F (steps S113 to S117). Before the flow condition determination process is initiated, a process of initiating the driving of the compressor 21 is performed as shown hereinbelow (steps S111, S112).

In step S111, the control part 11 determines whether or not the controller 90 has received a command not for the air-cooling operation but for the air-warming operation from the user.

In step S112, the control part 11 initiates startup of the compressor 21 and gradually increases the frequency of the compressor 21.

In step S113, the control part 11 initiates the flow condition determination process, stores the detected pressure data of the pressure sensor 29*a*, and initiates a count of the flow detection time duration by the timer 95.

In step S114, the control part 11 determines whether or not the flow detection time duration of 10 seconds has elapsed since the start of the count by the timer 95, and transitions to step S115 if the flow detection time duration has elapsed. If the flow detection time duration has not yet elapsed, step S114 is repeated.

In step S115, the control part 11 acquires the detected pressure data of the pressure sensor 29*a* at the elapse of the flow detection time duration and transitions to step S116.

In step S116, the control part 11 determines whether or not the detected pressure of the pressure sensor 29*a* acquired in step S115 has increased above the detected pressure data of the pressure sensor 29*a* stored in step S113 by a predetermined pressure (e.g. 5 MPA) or more. Specifically, the control part determines whether or not an increase in the refrigerant pressure was successfully detected during the flow detection time duration. When a pressure increase has been successfully detected, the control part determines that refrigerant is flowing to the indoor-side gas tube B and a refrigerant flow is ensured, ends the flow condition determination process, and transitions to either the rapid pressure-increasing process at startup in which the output of the electromagnetic induction heating unit 6 is used to its maximum limit, the sensor-separated detection process, or another process, similar to the embodiment described above.

When a pressure increase has not been successfully detected, the control part transitions to step S117.

In step S117, the control part 11 assumes that the quantity of refrigerant flowing to the indoor-side gas tube B is insufficient for induction heating by the electromagnetic induction heating unit 6, and the control part 11 outputs a flow abnormality display on the display screen of the controller 90.

Thus, when the flow condition determination process is performed using the pressure sensor 29*a*, the flow condition determination process can be initiated immediately upon initiating driving of the compressor 21. Specifically, when the flow condition determination process is performed using the electromagnetic induction thermistor 14 as in the embodiment described above, the process of waiting until the frequency of the compressor 21 reaches the predetermined minimum frequency Qmin is unnecessary, and the flow condition determination process can be ended sooner. Therefore, the above-described flow detection time duration can be set to a shorter time duration. Specifically, in the embodiment described above, since temperature changes of the refrigerant in the accumulation tube F or the outdoor heat exchanger 23 are detected, the refrigerant will sometimes be in a gas-liquid two-phase state and its temperature kept constant at the saturation temperature at the point in time when startup of the compressor 21 is initiated. This is because there are instances when the temperatures detected by the electromagnetic induction thermistor 14 and the outdoor heat exchange temperature sensor 29*c* are constant at the saturation temperature and do not change for a while until the compressor 21 is driven and the saturation temperature begins to decrease.

(I)

In the embodiment described above, an example was described of a case in which the flow condition determination process was performed in order to detect the flow of refrigerant to the accumulation tube F when the air-warming operation was initiated from an operationally stopped state of the air conditioning apparatus 1.

However, the present invention is not limited to this example.

Figure 23:
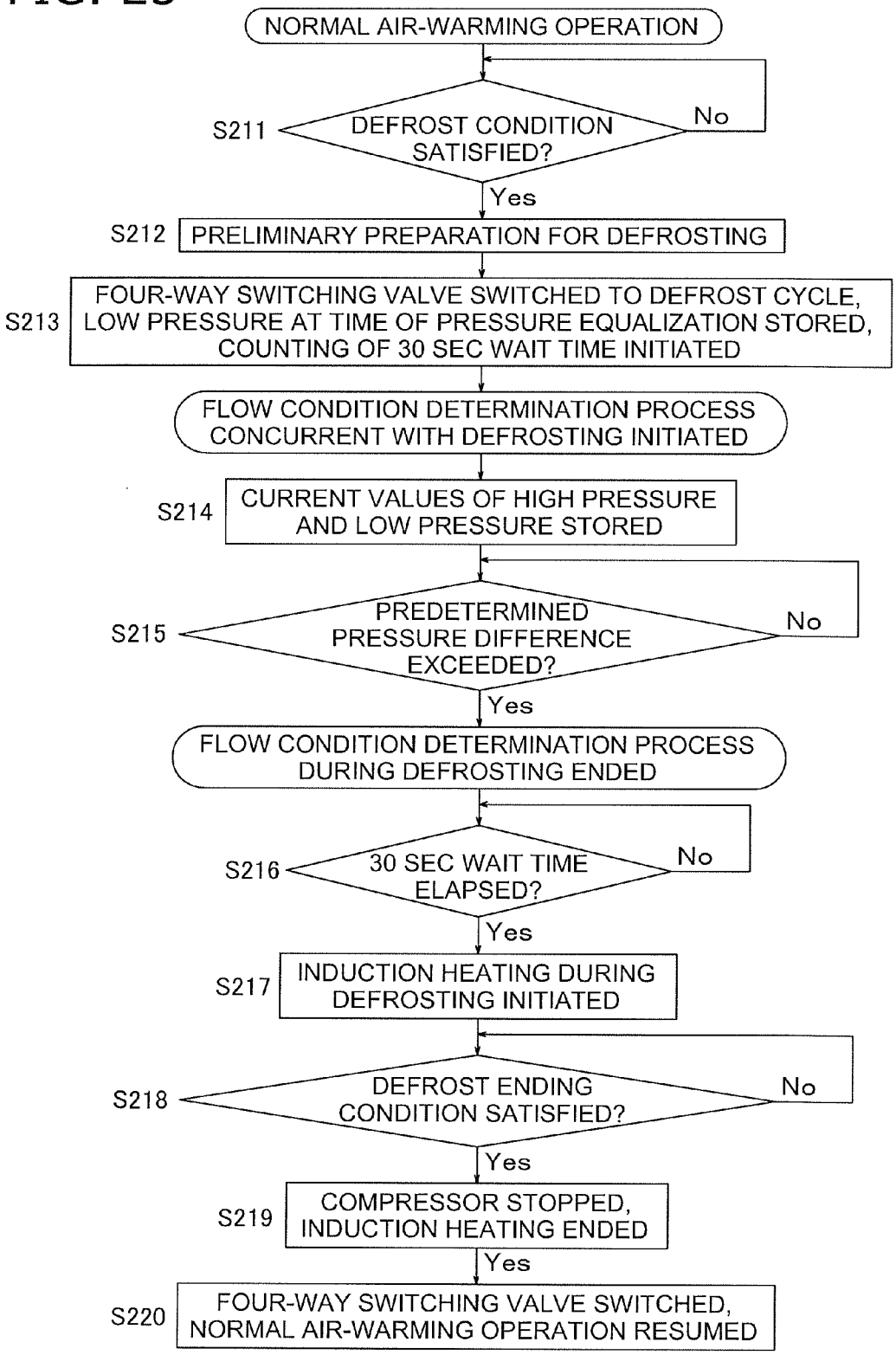
FIG. 23 is a flowchart showing an example in which the flow of refrigerant is perceived during a defrosting operation of another embodiment (I).

For example, even at times other than the initiation of the air-warming operation, induction heating by the electromagnetic induction heating unit 6 may be performed when a defrosting operation is performed for removing frost deposited on the outdoor heat exchanger 23, for example, and the condition for initiating the induction heating may be that a flow condition determination process concurrent with defrosting be performed. Such a flow condition determination process concurrent with defrosting is described hereinbelow with the flowchart of FIG. 23.

In step S211, while the normal air-warming operation is being performed, control part 11 determines whether or not the temperature detected by the outdoor heat exchange temperature sensor 29*c* satisfies a predetermined defrost condition. This defrost condition can be that the detected temperature of the outdoor heat exchange temperature sensor 29*c* be a temperature lower than 10° C., for example. When it has been determined that the defrost condition is satisfied, a defrost signal is transmitted as an internal signal, a defrost time duration begins to be counted by the timer 95, and the process transitions to step S212. At this time, if induction heating is being performed by the electromagnetic induction heating unit 6, the induction heating is stopped. The driving of the indoor fan 42 is also stopped, and the degree of opening of the outdoor electric expansion valve 24 is reduced.

If the defrost condition has not been satisfied, the process of step S211 is repeated.

In step S212, as a preliminary preparation for initiating the defrosting operation, the control part 11 waits for 40 seconds to elapse while maintaining the rotating speed of the compressor 21 above the predetermined minimum frequency Qmin. The process then transitions to step S213.

In step S213, the control part 11 switches the connection state of the four-way switching valve 22 from the connection state of the air-warming cycle to the connection state of the air-cooling cycle (switches from the solid lines to the dotted lines in FIG. 1), and after the high pressure and low pressure values have equalized, the control part 11 initiates the supply of discharged refrigerant to the outdoor heat exchanger 23 to begin defrosting, and stores the initial value of the low pressure at the time of pressure equalization. The timer 95 then begins counting a 30 second wait time for initiating induction heating by the electromagnetic induction heating unit 6.

Furthermore, when the control part 11 initiates the count of this 30 second wait time, the control part 11 confirms that the rotating speed of the compressor 21 is being maintained above the predetermined minimum frequency Qmin, and also confirms that the attached state of the electromagnetic induction thermistor 14 has been confirmed to be appropriate by the sensor-separated detection process at the start of the air-warming operation (see the embodiment described above). When this confirmation is successful, a flow condition determination process concurrent with defrosting is initiated, and the control part transitions to step S214.

In step S214, the control part 11 perceives and stores the current low pressure value and the current high pressure value, and transitions to step S215.

In step S215, the control part 11 determines if the difference between the initial low pressure value at the time of pressure equalization stored in step S213 and the current low pressure value stored in step S214 is greater than a predetermined pressure difference (e.g. 3 kg/cm$^2$), or if the difference between the current high pressure value acquired in step S214 and the current low pressure value acquired in step S214 is greater than a predetermined pressure difference. Specifically, after the four-way switching valve 22 has been switched to the defrosting cycle, it is determined whether or not there has begun to be a high-low pressure difference. The flow condition determination process at the start of the air-warming operation confirms the flow of refrigerant by the change in the detected temperature of the electromagnetic induction thermistor 14, but since this takes place immediately after the connection state of the four-way switching valve 22 is switched during defrosting, the refrigerant temperature is easily maintained at a constant, and it is difficult to perceive the flow of refrigerant as a temperature change. Therefore, in the flow condition determination process during defrosting, the flow of refrigerant is confirmed by the pressure difference.

When the pressure difference is greater than the predetermined pressure difference, the process advances to step S216. On the other hand, when the flow detection time duration has not yet elapsed, step S215 is repeated. When this step is repeated, if the user inputs a command to end the flow condition determination process during defrosting via the controller 90, the flow condition determination process during defrosting ends at that time.

In step S216, the control part 11 determines whether or not the 30 second wait time that began to be counted in step S213 has elapsed. If the wait time has elapsed, the control part advances to step S217. If the wait time has not elapsed, the control part waits until the wait time has elapsed.

In step S217, the control part 11 initiates induction heating by the electromagnetic induction heating unit 6. The induction heating by the electromagnetic induction heating unit 6 herein is performed at an output of 2 kW established as the maximum upper limit output, and the control part 11 performs control with the objective of bringing the detected temperature of the electromagnetic induction thermistor 14 to 40° C. Due to this induction heating, the heat quantity of refrigerant sent to the outdoor heat exchanger 23 during the defrosting operation can be further increased, and the time required for defrosting can be shortened. The process then transitions to step S218.

In step S218, the control part 11 determines whether or not a defrost ending condition has been satisfied, which is either that the detected temperature of the outdoor heat exchange temperature sensor 29*c* is 10° C. or higher, or that 10 or more minutes have elapsed since the defrost signal was transmitted in step S211. When the control part determines that a defrost ending condition has been satisfied, the control part transitions to step S219. When the control part determines that no defrost ending condition has been satisfied, step S218 is repeated.

In step S219, the control part 11 stops the compressor 21, ends induction heating by the electromagnetic induction heating unit 6, and transitions to step S220.

In step S220, the control part 11 returns the four-way switching valve 22 to the normal air-warming cycle, resumes the driving of the compressor 21, and returns to the normal air-warming operation.

Various processes concurrent with the defrosting operation were described above, but the aforementioned low pressure or high pressure may be the pressure detected by the pressure sensor 29*a*; or the pressure may be a value obtained by using the detected temperature of the indoor heat exchange temperature sensor 44 as a refrigerant saturation temperature and converting it to pressure, a value obtained by using the detected temperature of the outdoor heat exchange temperature sensor 29*c* as a refrigerant saturation temperature and converting it to pressure, or another value.

When the normal air-warming operation is resumed in step S220, the same flow condition determination process may be performed, which was performed at the start of the air-warming operation in the above embodiment.

Another option of preliminary preparations for initiating the defrosting operation is, instead of step S212, to reduce the rotating speed of the compressor 21 to a predetermined rotating speed and wait for 40 seconds to elapse, and instead of step S213, to increase the rotating speed of the compressor 21 along with the switching of the four-way switching valve 22. In this case, since the four-way switching valve 22 is switched after the rotating speed of the compressor 21 is reduced, the sound that occurs with switching can be minimized.

(J)

In the embodiment described above, an example was described of a case in which the accumulation tube F is configured as a double-layer pipe comprising the copper tube F1 and the magnetic tube F2.

However, the present invention is not limited to this example.

Figure 24:
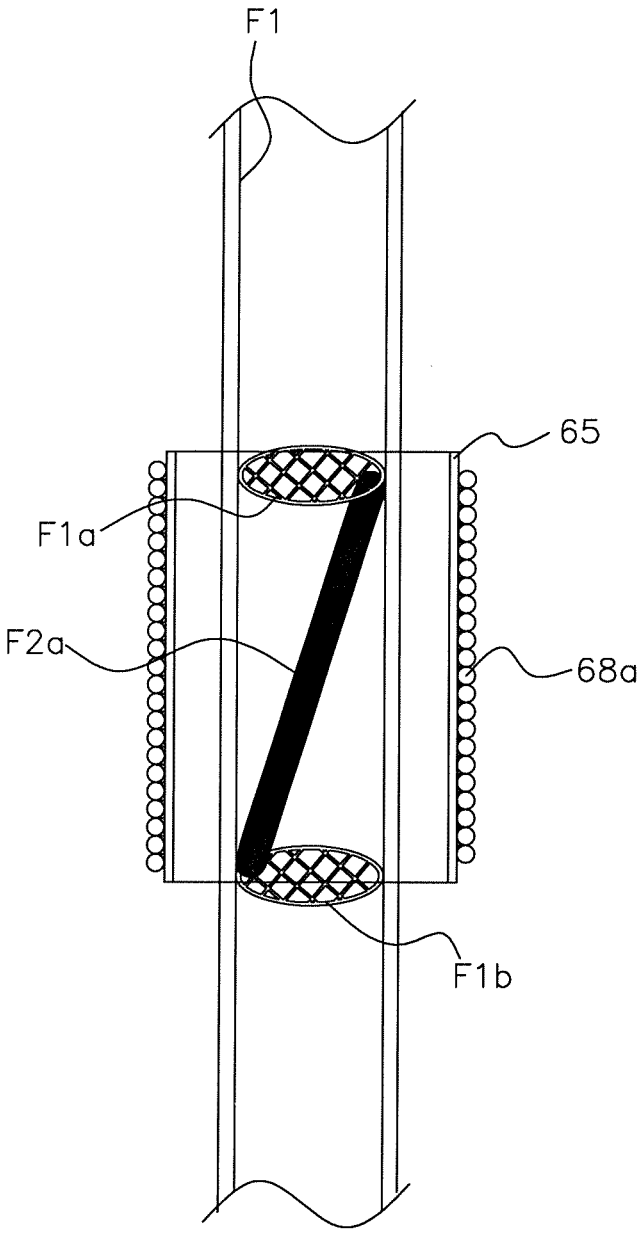
FIG. 24 is an explanatory view of a refrigerant tube of another embodiment (J).

A magnetic member F2*a* and two stoppers F1A, F1B may be disposed inside the accumulation tube F and a refrigerant tube as a heated object, for example, as shown in FIG. 24. The magnetic member F2*a* is a member containing a magnetic material whereby heat is generated by electromagnetic induction heating in the embodiment described above. The stoppers F1A, F1B are placed in two locations inside the copper tube F1, constantly permitting refrigerant to pass through but not permitting the magnetic member F2*a* to pass through. The magnetic member F2*a* thereby does not move despite the flow of refrigerant. Therefore, the intended heating position in the accumulation tube F, for example, can be heated. Furthermore, since the heat-generating magnetic member F2*a* and the refrigerant are in direct contact, heat transfer efficiency can be improved.

(K)

The magnetic member F2*a* described in the other embodiment (I) may be positioned within the tube without the use of the stoppers F1*a*, F2*b*.

Figure 25:
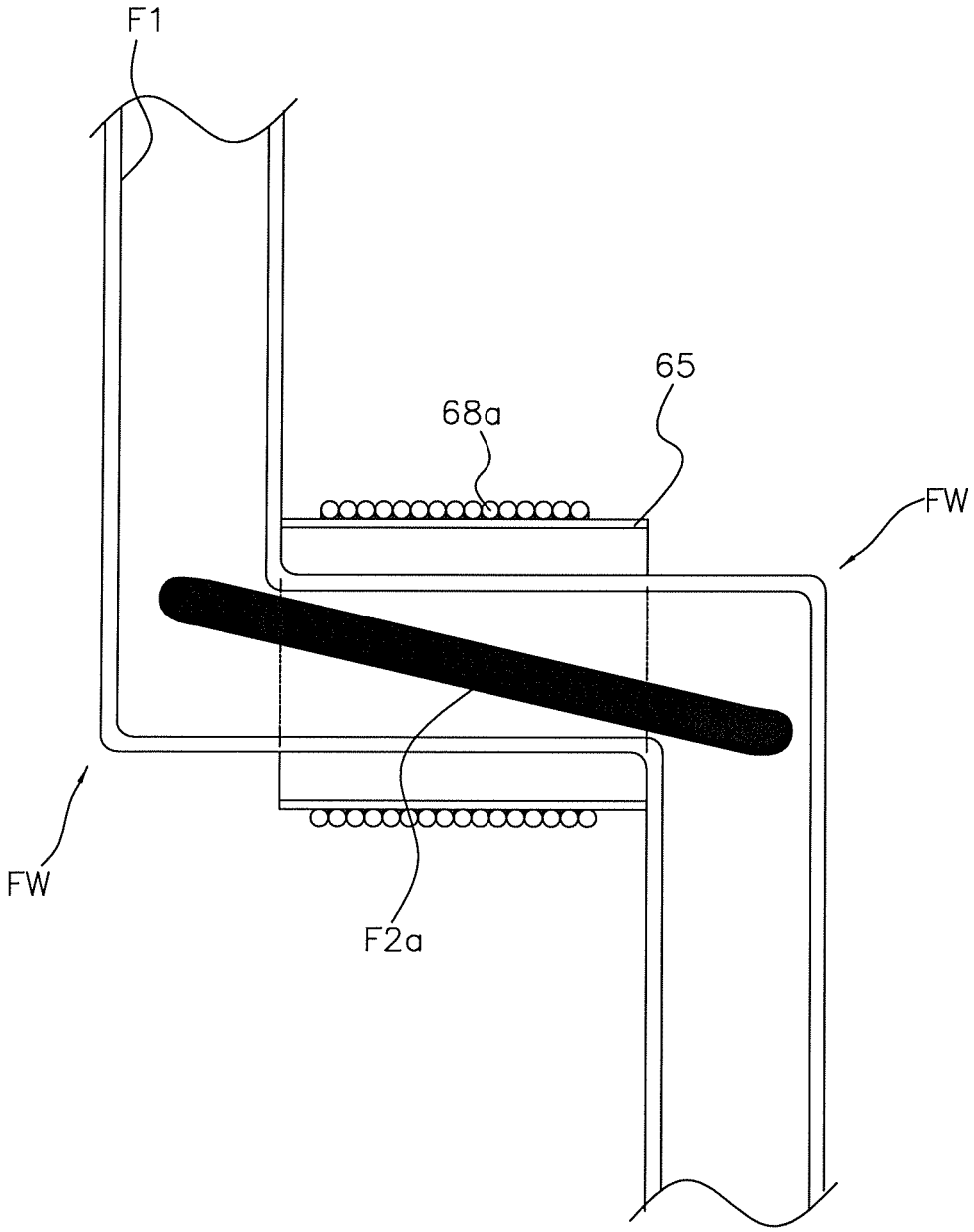
FIG. 25 is an explanatory view of a refrigerant tube of another embodiment (K).

Bent portions FW may be provided in two locations in the copper tube F1, the magnetic member F2*a* may be placed inside the copper tube F1 between these two bent portions FW, for example, as shown in FIG. 25. The movement of the magnetic member F2*a* can be restricted while permitting refrigerant to pass through in this manner as well.

(L)

In the embodiment described above, an example was described of a case in which the coil 68 was wound around the accumulation tube F in a helical formation.

However, the present invention is not limited to this example.

Figure 26:
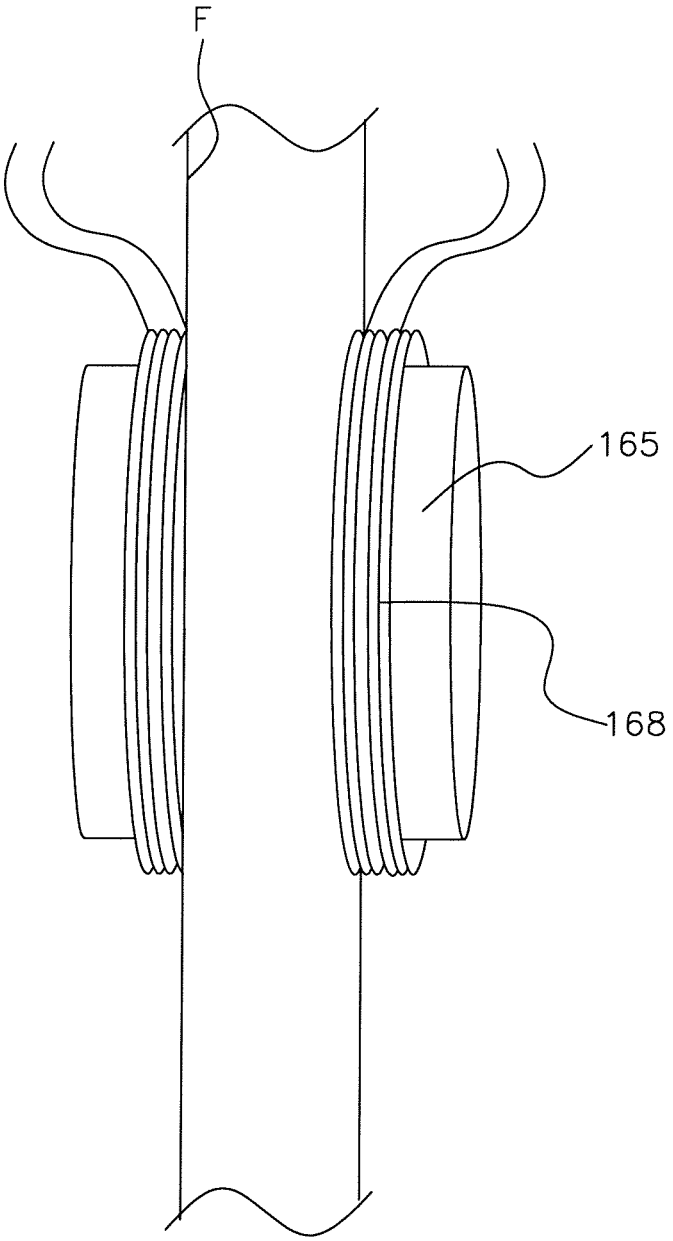
FIG. 26 is a view showing an example of arranging coils and a refrigerant tube of another embodiment (L).

For example, a coil 168 wound around a bobbin main body 165 may be disposed around the periphery of the accumulation tube F without being wound over the accumulation tube F, as shown in FIG. 26. The bobbin main body 165 is arranged so that its axial direction is substantially perpendicular to the axial direction of the accumulation tube F. Two bobbin main bodies 165 and coils 168 each are placed separately so as to sandwich the accumulation tube F.

Figure 27:
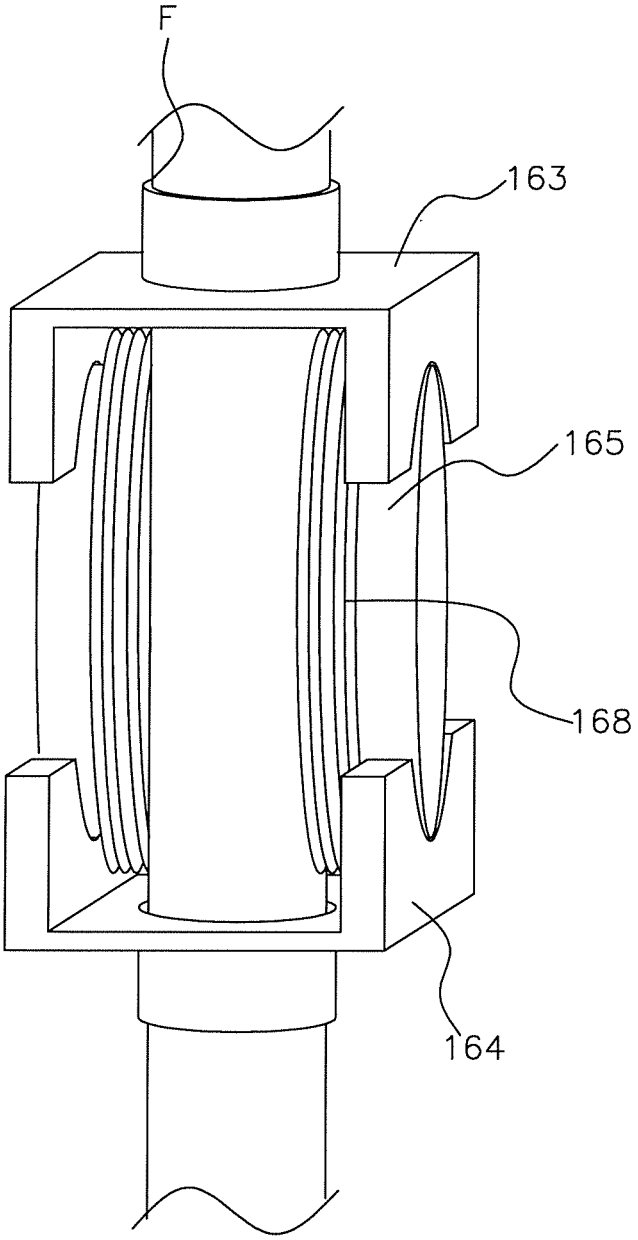
FIG. 27 is a view showing an example or arranging bobbin covers of another embodiment (L).

In this case, a first bobbin cover 163 and a second bobbin cover 164 which pass through the accumulation tube F may be arranged in a state of being fitted over the bobbin main body 165, as shown in FIG. 27, for example.

Figure 28:
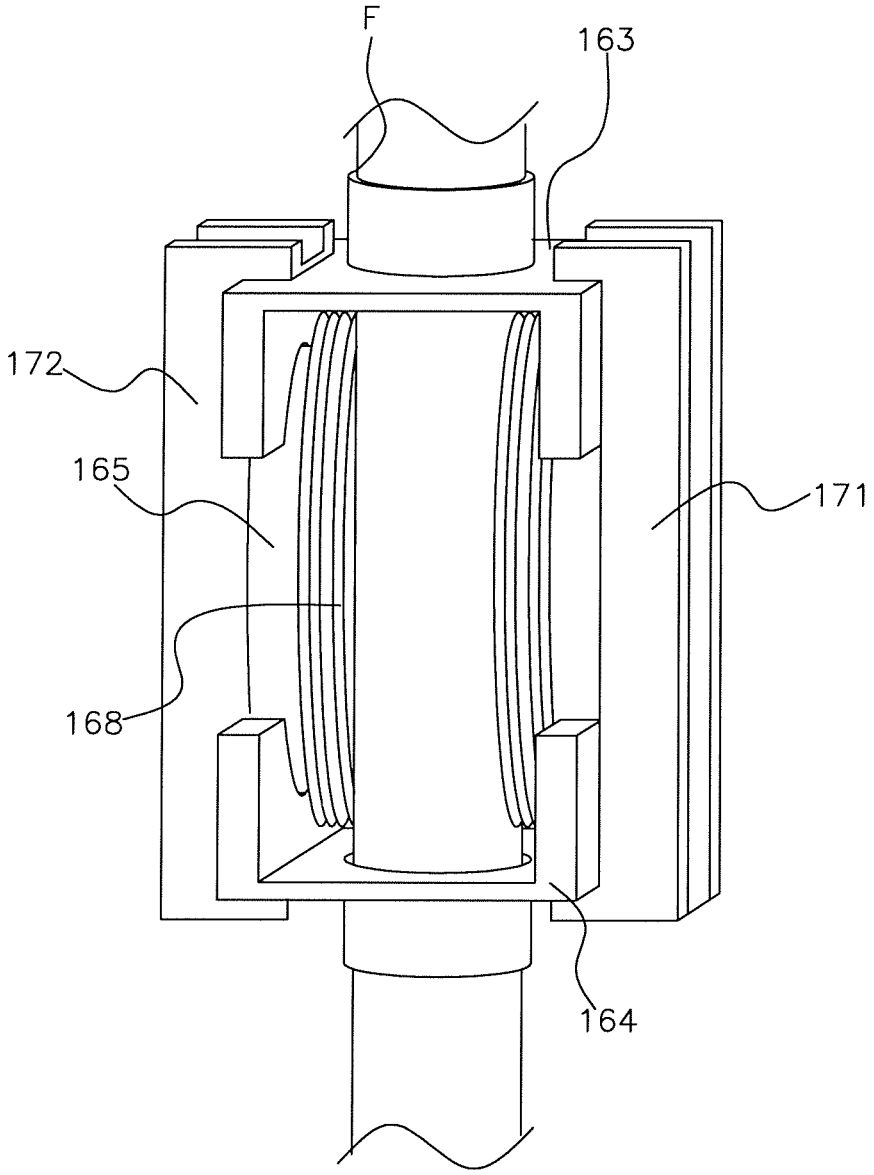
FIG. 28 is a view showing an example of arranging ferrite cases of another embodiment (L).

Furthermore the first bobbin cover 163 and the second bobbin cover 164 may be fixed in place by being sandwiched by a first ferrite case 171 and a second ferrite case 172, as shown in FIG. 28. In FIG. 28, an example is shown of a case in which two ferrite cases are arranged so as to sandwich the accumulation tube F, but they may be arranged in four directions similar to the embodiment described above. The ferrite may also be accommodated similar to the embodiment described above.

<Other>

Embodiments of the present invention were described above in several examples, but the present invention is not limited to these embodiments. For example, the present invention also includes combined embodiments obtained by suitably combining different portions of the above embodiments, within a range that can be carried out based on the descriptions by those skilled in the art.

INDUSTRIAL APPLICABILITY

If the present invention is used, the refrigerant temperature can be prevented from rising too high even when refrigerant is heated by a system of electromagnetic induction heating, and the present invention is therefore particularly useful in an electromagnetic induction heating unit and an air conditioning apparatus in which refrigerant is heated using electromagnetic induction.

What is claimed is:

1. An air conditioning apparatus comprising:

a refrigerant circuit having a compressor configured to circulate refrigerant, the compressor being capable of executing two different compression states of different compressor outputs, one being a first compression state and the other being a second compression state having a frequency higher than the frequency of the first compression state, an intake-side heat exchanger connected to an intake side of the compressor, a discharge-side heat exchanger connected to a discharge side of the compressor, an expansion valve configured and arranged to lower pressure of refrigerant flowing from the discharge-side heat exchanger to the intake-side heat exchanger, and a refrigerant tube including a first refrigerant tube part connecting the compressor and the intake-side heat exchanger, a second refrigerant tube part connecting the compressor and the discharge-side heat exchanger, a third refrigerant tube part connecting the expansion valve and the intake-side heat exchanger, and a fourth refrigerant tube part connecting the expansion valve and the discharge-side heat exchanger, with elements of the refrigerant circuit being connected in series with the first, second, third and fourth refrigerant tube parts to form a closed loop;

a magnetic material member arranged to make thermal contact with at least one of the refrigerant tube and a refrigerant flowing through the refrigerant tube;

a magnetic field generator arranged to generate a magnetic field in order to inductively heat the magnetic material member;

a detector arranged and configured to detect either temperature or pressure in refrigerant flowing through a predetermined portion of the refrigerant circuit; and a controller configured to initiate the magnetic field generator in response to determining that a value detected by the detector changes when the compressor changes from the second compression state to the first compression state or when the compressor changes from the first compression state to the second compression state.

2. The air conditioning apparatus according to claim 1, wherein the detector is temperature detector arranged and configured to detect temperature or temperature change.

3. The air conditioning apparatus according to claim 1, wherein the controller is further configured to perform startup degree of opening control to narrow a degree of opening of the expansion valve so that the degree of opening will be narrower than the degree of opening of the expansion valve under the same conditions as subcooling degree constant control in which a subcooling degree is made constant in refrigerant flowing to an expansion valve side of the discharge-side heat exchanger when the compressor is in the second compression state.

4. The air conditioning apparatus according to claim 1, wherein the controller is further configured to initiate the magnetic field generator in response to determining that the value detected by the detector changes when the compressor changes from the second compression state to the first compression state or when the compressor changes from the first compression state to the second compression state, and determining that the output level of the compressor is maintained at a higher output level than the second compression state or is maintained at the second compression state.

5. The air conditioning apparatus according to claim 1, wherein the first compression state is a state in which a determining minimum mass flow rate of the refrigerant is ensured; and the second compression state is a state that continues after the first compression state, and in which a refrigerant mass flow rate that exceeds the determining minimum mass flow rate is ensured.

6. The air conditioning apparatus according to claim 2, wherein the predetermined portion is at least one of the intake-side heat exchanger, a portion of the refrigerant circuit connecting the expansion valve and the intake-side heat exchanger, and a portion of the refrigerant circuit connecting the intake-side heat exchanger and the compressor.

7. The air conditioning apparatus according to claim 1, wherein the controller is further configured to initiate the magnetic field generator in response to determining that the value detected by the detector changes when the compressor changes from the second compression state to the first compression state or when the compressor changes from the first compression state to the second compression state, and determining that the output level of the compressor has fallen to or below the output level in the first compression state.

8. The air conditioning apparatus according to claim 1, wherein the controller includes a display screen, and the controller is further configured to cause the display screen to communicate that the magnetic-field-generating-permission condition is not satisfied.

9. The air conditioning apparatus according to claim 1, wherein a magnitude of the magnetic field generated by the magnetic field generator is adjustable; and the controller is further configured to initiate the magnetic field generator in response to determining that the value detected by the detector changes when the compressor changes from the second compression state to the first compression state or when the compressor changes from the first compression state to the second compression state, determining that the output level of the compressor is maintained either at a higher output level than the second compression state or at the second compression state, and determining that a difference in detection results of the detector before and after the magnetic field is generated by the magnetic field generator is less than a predetermined determining difference while output level of the compressor is maintained at either a constant level or within a predetermined range including a predetermined upper limit and a predetermined lower limit.

10. The air conditioning apparatus according to claim 2, further comprising an elastic member applying an elastic force to the temperature detector, the elastic force pressing the temperature detector against the predetermined portion.

11. The air conditioning apparatus according to claim 2, wherein a magnitude of the magnetic field generated by the magnetic field generator is adjustable; and the controller is further configured to initiate the magnetic field generator in response to determining that the value detected by the detector changes when the compressor changes from the second compression state to the first compression state or when the compressor changes from the first compression state to the second compression state, determining that the output level of the compressor is maintained either at a higher output level than the second compression state or at the second compression state, and determining that a difference in detection results of the detector before and after the magnetic field is generated by the magnetic field generator is less than a predetermined determining difference while output level of the compressor is maintained at either a constant level or within a predetermined range including a predetermined upper limit and a predetermined lower limit.

12. The air conditioning apparatus according to claim 2, wherein the controller is further configured to perform startup degree of opening control to narrow a degree of opening of the expansion valve so that the degree of opening will be narrower than the degree of opening of the expansion valve under the same conditions as subcooling degree constant control in which a subcooling degree is made constant in refrigerant flowing to an expansion valve side of the discharge-side heat exchanger when the compressor is in the second compression state.

13. The air conditioning apparatus according to claim 12, wherein the controller is further configured to initiate the magnetic field generator in response to determining that the value detected by the detector changes when the compressor changes from the second compression state to the first compression state or when the compressor changes from the first compression state to the second compression state, and determining that the output level of the compressor is maintained at a higher output level than the second compression state or is maintained at the second compression state.

14. The air conditioning apparatus according to claim 13, wherein the first compression state is a state in which a determining minimum flow quantity of the refrigerant is ensured; and the second compression state is a state that continues after the first compression state, and in which a refrigerant flow quantity that exceeds the determining minimum flow quantity is ensured.

15. The air conditioning apparatus according to claim 14, wherein the controller is further configured to initiate the magnetic field generator in response to determining that the value detected by the detector changes when the compressor changes from the second compression state to the first compression state or when the compressor changes from the first compression state to the second compression state, and determining that the output level of the compressor has fallen to or below the output level in the first compression state.

16. The air conditioning apparatus according to claim 15, further comprising the controller includes a display screen, and the controller is further configured to cause the display screen to communicate that the magnetic-field-generating-permission condition is not satisfied.

* * * * *